US012060672B2

(12) United States Patent
Cobb et al.

(10) Patent No.: US 12,060,672 B2
(45) Date of Patent: Aug. 13, 2024

(54) APPARATUS AND METHOD FOR THE TREATMENT OF A SUBSTRATE WITH A MULTIPLICITY OF SOLID PARTICLES

(71) Applicant: Xeros Limited, Rotherham (GB)

(72) Inventors: Thomas Andrew Cobb, Rotherham (GB); Joseph Mattley, Rotherham (GB); Liam Roberts, Rotherham (GB); Gareth Evan Lyn Jones, Bath and North East Somerset (GB)

(73) Assignee: Xeros Limited, Rotherham (GB)

( * ) Notice: Subject to any disclaimer, the term of this patent is extended or adjusted under 35 U.S.C. 154(b) by 951 days.

(21) Appl. No.: 16/497,070

(22) PCT Filed: Dec. 19, 2017

(86) PCT No.: PCT/GB2017/053815
§ 371 (c)(1),
(2) Date: Sep. 24, 2019

(87) PCT Pub. No.: WO2018/172725
PCT Pub. Date: Sep. 27, 2018

(65) Prior Publication Data

US 2020/0378054 A1 Dec. 3, 2020

(30) Foreign Application Priority Data

Mar. 24, 2017 (GB) ..... 1704736

(51) Int. Cl.
*D06F 58/02* (2006.01)
*D06F 35/00* (2006.01)
(Continued)

(52) U.S. Cl.
CPC ..... *D06F 58/02* (2013.01); *D06F 35/00* (2013.01); *D06F 37/02* (2013.01); *D06F 58/04* (2013.01);
(Continued)

(58) Field of Classification Search
None
See application file for complete search history.

(56) References Cited

U.S. PATENT DOCUMENTS 8,959,961 B2 2/2015 Jenkins et al.
8,974,545 B2 3/2015 Burkinshaw et al.
(Continued)

FOREIGN PATENT DOCUMENTS

CN 102061589 A 5/2011
CN 102317534 A 1/2012
(Continued)

OTHER PUBLICATIONS

International Search Report and Written Opinion for International Patent Application No. PCT/GB2017/053815, mailed Feb. 26, 2018 (15 pages).

*Primary Examiner* — Marc Lorenzi
(74) *Attorney, Agent, or Firm* — Clark & Elbing LLP

(57) ABSTRACT

An apparatus for use in the treatment of substrates with a solid particulate material, said apparatus comprising: (a) a housing having mounted therein a rotatably mounted drum (8) having an inner surface and an end wall; and (b) access means for introducing said substrates into said drum, wherein said drum comprises storage means (2) for storage of said solid particulate material and a plurality of flow paths to facilitate flow of said solid particulate material between said storage means and the interior of said drum (8), characterised in that: said drum (8) comprises a dispensing flow path (5) to facilitate flow of said solid particulate material from said storage means (2) to the interior of said drum (8), and a collecting flow path (6) to facilitate flow of said particulate material from the interior of said drum (8) to said storage means (2), wherein said dispensing flow path (5) and said collecting flow path (6) are different flow paths.

24 Claims, 12 Drawing Sheets

(51) Int. Cl.

| | |
|---|---|
| ***D06F 37/02*** | (2006.01) |
| ***D06F 58/04*** | (2006.01) |
| ***D06F 58/06*** | (2006.01) |
| *D06F 103/36* | (2020.01) |
| *D06M 23/08* | (2006.01) |

(52) U.S. Cl.

CPC ..... *D06F 58/06* (2013.01); *D06F 2103/36* (2020.02); *D06M 23/08* (2013.01)

(56) References Cited

U.S. PATENT DOCUMENTS

| | | | | |
|---|---|---|---|---|
| 9,017,423 | B2 | 4/2015 | Burkinshaw et al. | |
| 9,121,000 | B2 | 9/2015 | Burkinshaw et al. | |
| 9,127,882 | B2 | 9/2015 | Jenkins et al. | |
| 9,297,107 | B2 | 3/2016 | Jenkins | |
| 9,315,766 | B2 | 4/2016 | He et al. | |
| 9,404,210 | B2 | 8/2016 | He et al. | |
| 9,410,278 | B2 | 8/2016 | He et al. | |
| 9,476,155 | B2 | 10/2016 | He et al. | |
| 9,487,898 | B2 | 11/2016 | He et al. | |
| 9,523,169 | B2 | 12/2016 | Sawford et al. | |
| 9,550,966 | B2 | 1/2017 | Burkinshaw et al. | |
| 9,587,337 | B2 | 3/2017 | He et al. | |
| 9,587,340 | B2 | 3/2017 | Jenkins et al. | |
| 9,631,314 | B2 | 4/2017 | Yin et al. | |
| 9,803,307 | B2 | 10/2017 | Jenkins et al. | |
| 9,834,881 | B2 | 12/2017 | Sawford et al. | |
| 9,845,516 | B2 | 12/2017 | Steele | |
| 9,850,455 | B2 | 12/2017 | Jenkins et al. | |
| 9,850,619 | B2 | 12/2017 | Wells et al. | |
| 9,914,901 | B2 | 3/2018 | Burkinshaw et al. | |
| 9,932,700 | B2 | 4/2018 | Wells et al. | |
| 10,017,895 | B2 | 7/2018 | Wells et al. | |
| 10,081,900 | B2 | 9/2018 | Wells et al. | |
| 10,287,642 | B2 | 5/2019 | Scott | |
| 10,301,691 | B2 | 5/2019 | Feyisa et al. | |
| 10,316,448 | B2 | 6/2019 | He et al. | |
| 10,494,590 | B2 | 12/2019 | Abercrombie et al. | |
| 10,590,499 | B2 | 3/2020 | Ashfaq et al. | |
| 10,597,814 | B2 | 3/2020 | Wells et al. | |
| 10,745,769 | B2 | 8/2020 | Steele | |
| 10,773,976 | B2 | 9/2020 | Scott et al. | |
| 10,781,404 | B2 | 9/2020 | Bird et al. | |
| 10,808,289 | B2 | 10/2020 | Sadeghi | |
| 11,299,839 | B2 | 4/2022 | Jones et al. | |
| 2004/0013761 | A1 | 1/2004 | Huttlin | |
| 2011/0100068 | A1 | 5/2011 | Simsek | |
| 2011/0296628 | A1* | 12/2011 | Jenkins | D06F 35/00 68/142 |
| 2012/0048299 | A1 | 3/2012 | Jenkins et al. | |
| 2013/0167882 | A1 | 7/2013 | Burkinshaw et al. | |
| 2014/0201929 | A1 | 7/2014 | He et al. | |
| 2014/0230160 | A1 | 8/2014 | He et al. | |
| 2014/0317860 | A1 | 10/2014 | He et al. | |
| 2015/0027173 | A1 | 1/2015 | Wu et al. | |
| 2015/0096128 | A1 | 4/2015 | Sawford et al. | |
| 2015/0152357 | A1 | 6/2015 | Abercrombie et al. | |
| 2015/0152585 | A1 | 6/2015 | Sawford et al. | |
| 2015/0175945 | A1 | 6/2015 | Waddon et al. | |
| 2015/0252511 | A1 | 9/2015 | Roberts et al. | |
| 2016/0040260 | A1 | 2/2016 | Steele | |
| 2016/0122936 | A1* | 5/2016 | Wells | D06F 58/02 34/108 |
| 2016/0195409 | A1 | 7/2016 | Goldberg et al. | |
| 2016/0197998 | A1 | 7/2016 | Carleo | |
| 2016/0251602 | A1 | 9/2016 | Steele et al. | |
| 2016/0251603 | A1 | 9/2016 | Steele et al. | |
| 2016/0251795 | A1* | 9/2016 | Wells | D06F 21/14 8/137 |
| 2017/0051447 | A1 | 2/2017 | He et al. | |
| 2017/0159222 | A1 | 6/2017 | Jenkins et al. | |
| 2017/0240982 | A1 | 8/2017 | Sadeghi | |
| 2017/0241061 | A1 | 8/2017 | Wells et al. | |
| 2017/0247771 | A1 | 8/2017 | Scott | |
| 2017/0267949 | A1 | 9/2017 | Bird et al. | |
| 2018/0057777 | A1 | 3/2018 | Waddon et al. | |
| 2018/0127914 | A1 | 5/2018 | Wells et al. | |
| 2018/0134994 | A1 | 5/2018 | Steele et al. | |
| 2018/0141089 | A1 | 5/2018 | Sawford et al. | |
| 2018/0216049 | A1 | 8/2018 | Bird et al. | |
| 2019/0144959 | A1 | 5/2019 | Ashfaq et al. | |
| 2019/0210892 | A1 | 7/2019 | Scott et al. | |
| 2019/0211288 | A1 | 7/2019 | Potts et al. | |
| 2019/0233760 | A1 | 8/2019 | Lavery et al. | |
| 2020/0002650 | A1 | 1/2020 | Servin et al. | |
| 2020/0316501 | A1 | 10/2020 | Jones | |
| 2021/0179979 | A1 | 6/2021 | Servin et al. | |

FOREIGN PATENT DOCUMENTS

| | | | |
|---|---|---|---|
| CN | 202175862 | U | 3/2012 |
| CN | 102425053 | A | 4/2012 |
| CN | 102425055 | A | 4/2012 |
| CN | 202214631 | U | 5/2012 |
| CN | 202214633 | U | 5/2012 |
| CN | 202298219 | U | 7/2012 |
| CN | 202298220 | U | 7/2012 |
| CN | 202298222 | U | 7/2012 |
| CN | 202323458 | U | 7/2012 |
| CN | 202359387 | U | 8/2012 |
| CN | 202359388 | U | 8/2012 |
| CN | 202359389 | U | 8/2012 |
| CN | 202359390 | U | 8/2012 |
| CN | 202359396 | U | 8/2012 |
| CN | 202492706 | U | 10/2012 |
| CN | 202543634 | U | 11/2012 |
| CN | 202543635 | U | 11/2012 |
| CN | 202543646 | U | 11/2012 |
| CN | 202543652 | U | 11/2012 |
| CN | 102899848 | A | 1/2013 |
| CN | 202688698 | U | 1/2013 |
| CN | 202755220 | U | 2/2013 |
| CN | 202755221 | U | 2/2013 |
| CN | 102953249 | A | 3/2013 |
| CN | 102953250 | A | 3/2013 |
| CN | 102953262 | A | 3/2013 |
| CN | 102978870 | A | 3/2013 |
| CN | 103061084 | A | 4/2013 |
| CN | 103061085 | A | 4/2013 |
| CN | 103061086 | A | 4/2013 |
| CN | 103061087 | A | 4/2013 |
| CN | 103087839 | A | 5/2013 |
| CN | 103103720 | A | 5/2013 |
| CN | 103103721 | A | 5/2013 |
| CN | 103122566 | A | 5/2013 |
| CN | 103122567 | A | 5/2013 |
| CN | 202913242 | U | 5/2013 |
| CN | 103225192 | A | 7/2013 |
| CN | 203049283 | U | 7/2013 |
| CN | 103361934 | A | 10/2013 |
| CN | 103361938 | A | 10/2013 |
| CN | 203370359 | U | 1/2014 |
| CN | 102061588 | B | 2/2014 |
| CN | 103556439 | A | 2/2014 |
| CN | 203530695 | U | 4/2014 |
| CN | 203530700 | U | 4/2014 |
| CN | 203530714 | U | 4/2014 |
| CN | 203530718 | U | 4/2014 |
| CN | 203530723 | U | 4/2014 |
| CN | 203530725 | U | 4/2014 |
| CN | 103285643 | B | 4/2015 |
| CN | 103451894 | B | 11/2015 |
| CN | 103556434 | B | 11/2015 |
| CN | 103556436 | B | 11/2015 |
| CN | 103556431 | B | 1/2016 |
| CN | 103556432 | B | 3/2016 |
| CN | 105420992 | A | 3/2016 |
| CN | 105420993 | A | 3/2016 |
| CN | 105421000 | A | 3/2016 |
| CN | 105442267 | A | 3/2016 |
| CN | 105593427 | A | 5/2016 |
| CN | 105612282 | A | 5/2016 |
| CN | 205329373 | U | 6/2016 |

(56) References Cited

FOREIGN PATENT DOCUMENTS

| | | | |
|---|---|---|---|
| CN | 205329374 | U | 6/2016 |
| CN | 205329380 | U | 6/2016 |
| CN | 205329384 | U | 6/2016 |
| EP | 2664703 | A1 | 11/2013 |
| EP | 2749685 | A1 | 7/2014 |
| WO | WO-2010/094959 | A1 | 8/2010 |
| WO | WO-2013026233 | A1 | 2/2013 |
| WO | WO-2013044635 | A1 | 4/2013 |
| WO | WO-2014/080192 | A1 | 5/2014 |
| WO | WO-2014/147389 | A1 | 9/2014 |
| WO | WO-2014/147390 | A1 | 9/2014 |
| WO | WO-2014/147391 | A1 | 9/2014 |
| WO | WO-2020/012024 | A1 | 1/2020 |
| WO | WO-2020/012026 | A1 | 1/2020 |
| WO | WO-2020/012027 | A1 | 1/2020 |
| WO | WO-2020/064830 | A1 | 4/2020 |
| WO | WO-2021/014152 | A1 | 1/2021 |
| WO | WO-2021/032986 | A1 | 2/2021 |

* cited by examiner

APPARATUS AND METHOD FOR THE TREATMENT OF A SUBSTRATE WITH A MULTIPLICITY OF SOLID PARTICLES

The present disclosure relates to an apparatus that employs a multiplicity of solid particles in the treatment of substrates, particularly a substrate which is or comprises a textile. The present disclosure further relates to the operation of an apparatus for the treatment of substrates using solid particles. The invention particularly relates to an apparatus and method for cleaning of soiled substrates.

Conventional methods for treating and cleaning of textiles and fabrics typically involve aqueous cleaning using large volumes of water. These methods generally involve aqueous submersion of fabrics followed by soil removal, aqueous soil suspension, and water rinsing. The use of solid particles to provide improvements in, and advantages over, these conventional methods is known in the art. For example PCT patent publication WO2007/128962 discloses a method for cleaning a soiled substrate using a multiplicity of solid particles. Other PCT patent publications which have related disclosures of cleaning methods include: WO2012/056252; WO2014/006424; WO2015/004444; WO2014/147390; WO2014/147391; WO2014/06425; WO2012/035343 and WO2012/167545. These disclosures teach apparatus and methods for treating or cleaning a substrate which offers several advantages over conventional methods including: improved treating/cleaning performance, reduced water consumption, reduced consumption of detergent and other treatment agents, and better low temperature treating/cleaning (and thus more energy efficient treating/cleaning). Other patent applications, for instance WO2014/167358, WO2014/167359, WO2016/05118, WO/2016/055789 and WO2016/055788, teach the advantages provided by solid particles in other fields such as leather treatment and tanning.

It would be desirable to provide even better apparatus for treatment methods which involve the use of a multiplicity of solid particles. In particular, it would be desirable to improve the efficiency and reliability, to further reduce water consumption, to facilitate quieter operation, to improve fabric care, and/or to reduce the power consumption and costs (including capital costs and/or running costs) of the apparatus and the operation thereof. It would also be desirable to reduce the complexity of the apparatus and the number of moving components therein. Furthermore, it would also be desirable to retrofit a conventional apparatus so that it is suitable for operation with a multiplicity of solid particles. It is an object of the present invention to address one or more of the aforementioned problems.

According to a first aspect of the invention, there is provided an apparatus for use in the treatment of substrates with a solid particulate material, said apparatus comprising:

(a) a housing having mounted therein a rotatably mounted drum having an inner surface and an end wall; and (b) access means for introducing said substrates into said drum, wherein said drum comprises storage means for storage of said solid particulate material and a plurality of flow paths to facilitate flow of said solid particulate material between said storage means and the interior of said drum, characterised in that:

said drum comprises a dispensing flow path to facilitate flow of said solid particulate material from said storage means to the interior of said drum, and a collecting flow path to facilitate flow of said particulate material from the interior of said drum to said storage means, wherein said dispensing flow path and said collecting flow path are different flow paths.

In the apparatus of the present invention, the flow of solid particulate material from the storage means towards the interior of the drum is preferably facilitated by the rotation of said drum in a dispensing direction and/or the flow of said solid particulate material from the interior of the drum towards the storage means is preferably facilitated by the rotation of said drum in a collecting direction, wherein rotation in the dispensing direction is in the opposite rotational direction to rotation in the collecting direction.

Accordingly, the apparatus can dispense with, and preferably does not comprise, a further storage means which is not attached to or integral with the drum. Similarly, the apparatus can dispense with, and preferably does not comprise a pump for circulating said solid particulate material between the storage means and the interior of the drum (i.e. from the storage means to the interior of the drum, and from the interior of the drum to the storage means). Preferably, the apparatus can dispense with, and preferably does not comprise, a pump for circulating said solid particulate material.

In addition, the amount of water used in the treatment of the substrates can be further reduced, relative to existing treatments which use solid particulate material, because water is not required to transport the solid particulate material around the apparatus. The apparatus and methods of the present invention therefore only require the water needed as the liquid medium in the treatment of the substrates, which provides a significant reduction in water consumption.

A further advantage of the storage means being located in the rotatable drum is that solid particulate material can be centrifugally dried, i.e. it can undergo one or more spin cycles to dry the particles. Centrifugal drying of the solid particulate material may be separate from or included in the operation of the apparatus to treat substrates. For instance, centrifugal drying may be effected concurrently with extraction step(s) for removing liquid medium, as described hereinbelow. Thus, the method described hereinbelow for treating a substrate optionally comprises the step of centrifugal drying of the solid particulate material. It will therefore be appreciated that an advantage of the present invention is the dry storage of the solid particulate material.

In a preferred embodiment, the dispensing flow path and/or the storage means are configured such that it takes at least 2, 3, 4, 5, 6, 7, 8, 9 or 10 rotations in the dispensing direction to begin to release the solid particulate material into the interior of said drum. Advantageously, this facilitates separation and untangling of substrates within the drum. This also facilitates controlled release of the solid particulate material during the treatment cycle, enabling increased and more consistent exposure of the substrates to the solid particulate material, thereby improving the treatment performance and efficiency.

It will be appreciated that the rate of flow of the solid particulate material between the storage means and the interior of the drum may be controlled, additionally or alternatively, by varying the rate of rotation of the drum and/or by intermittently rotating the drum, in either the dispensing or collecting direction. Similarly, the rate of flow of the solid particulate material between the storage means and the interior of the drum may be controlled, additionally or alternatively, by varying the direction of rotation of the drum. Thus, a given phase in the treatment cycle may comprise a number (n) of rotations in the collecting direction and further comprise a number (m) of rotations in the dispensing direction, where n and m are different and independently selected from integers or non-integers, thereby leading to a net increase or decrease in the amount of solid particulate material in the storage means and the interior of the drum.

The apparatus is preferably a front-loading apparatus, with the access means disposed in the front of the apparatus. Preferably the access means is or comprises a door. It will be appreciated that the drum has an opening at the opposite end of the drum to the end wall, suitably wherein the opening is aligned with the access means, and through which opening said substrates are introduced into said drum.

The rotatable drum is preferably cylindrical, but other configurations are also envisaged, including for instance hexagonal drums.

Thus, the inner surface of the drum is preferably a cylindrical inner surface.

The inner surface of the drum is the surface of the inner wall(s) of the drum. The inner wall(s) of the drum is/are joined to the end wall of the drum at the juncture of the inner and end walls. Thus, the inner surface is the surface of the inner wall of the drum which is disposed around the rotational axis of the drum, i.e. substantially perpendicular to the end wall of the drum.

For a cylindrical drum, the axis of the cylindrical drum is preferably the rotational axis of the drum. More generally, the inner and end walls of the drum define a three-dimensional volume in which the end wall bisects the rotational axis of the drum, and preferably bisects said rotational axis in a substantially perpendicular manner, and wherein the inner wall(s) is/are disposed around the rotational axis, preferably wherein the inner walls are substantially parallel to the rotational axis.

The inner surface of the drum preferably comprises perforations which have dimensions smaller than the dimensions of the solid particulate material so as to permit passage of fluids into and out of said drum but to prevent egress of said solid particulate material, as is conventional in many of the prior art apparatus suitable for treating substrates with solid particulate material. Preferably the housing of the apparatus is a tub which surrounds said drum, preferably wherein said tub and said drum are substantially concentric, preferably wherein the walls of said tub are unperforated but having disposed therein one or more inlets and/or one or more outlets suitable for passage of a liquid medium and/or one or more treatment formulation(s) into and out of the tub. Thus, the tub is suitably water-tight, permitting ingress and egress of the liquid medium and other liquid components only through pipes or ducting components.

Advantageously, during operation of the apparatus of the present invention, neither the drum nor the tub allows ingress or egress of the solid particulate material, which is retained by the drum throughout the treatment cycle by which substrates are treated in the apparatus. In other words, the solid particulate material remains in the storage means and/or in the interior of the drum and/or in the flow paths between the storage means and the interior of the drum throughout the treatment cycle, thereby obviating the need for a pump to circulate the particulate material.

The apparatus preferably comprises a seal between the access means and the tub such that, in use, liquid medium is not able to exit the tub.

The apparatus further comprises the typical components present in apparatus suitable for the treatment of substrates with solid particulate material, preferably in a liquid medium and/or in combination with one or more treatment formulation(s) as described in more detail hereinbelow. Thus, the apparatus preferably comprises at least one pump for circulation of the liquid medium, and associated ports and/or piping and/or ducting for transport of the liquid medium and/or one or more treatment formulation(s) into the apparatus, into the drum, out of the drum, and out of the apparatus. Preferably, the apparatus comprises a suitable drive means to effect rotation of the drum, and suitably a drive shaft to effect rotation of the drum. Preferably, the apparatus comprises heating means for heating the liquid medium. Preferably, the apparatus comprises mixing means to mix the liquid medium with one or more treatment formulation(s). The apparatus may further comprise one or more spray means to apply a liquid medium and/or one or more treatment formulation(s) into the interior of the drum and onto the substrate during the treatment thereof.

The apparatus typically further comprises an external casing, which surrounds the tub and drum.

It will be appreciated that the apparatus suitably further comprises a control means programmed with instructions for the operation of the apparatus according to at least one treatment cycle. The apparatus suitably further comprises a user interface for interfacing with the control means and/or apparatus.

The apparatus preferably comprises said solid particulate material.

The collecting flow path for the solid particulate material preferably comprises a collecting aperture with the drum being configured to bias solid particulate material present inside the drum towards the collecting aperture during rotation of the drum in the collecting direction.

Similarly, it is preferred that the dispensing flow path comprises a dispensing aperture with the drum being configured to bias solid particulate material present inside the storage means and/or the dispensing flow path towards a dispensing aperture during rotation of the drum in a dispensing direction.

In conventional apparatus, as well as in apparatus adapted for the treatment of substrates using solid particulate material, it is known to dispose one or more so-called "lifters" onto the inner surface of the drum. These lifters encourage circulation and agitation of the contents (i.e. the substrate(s), treatment agents and solid particulate material) within the drum during rotation of the drum. These lifters preferably take the form of a multiplicity of spaced apart elongate protrusion(s) affixed to the inner surface of the drum. Typically, the elongate protrusions are disposed on the inner surface of the drum such the elongate dimension of the protrusion is essentially perpendicular to the direction of rotation of the drum. Thus, the elongate protrusion preferably extends in a direction away from said end wall, and preferably extends from said end wall. The elongate protrusion therefore has an end proximal to the end wall and an end distal to the end wall.

The drum preferably has at least one elongate protrusion, and preferably from 2 to 10, preferably 2, 3, 4, 5 or 6 and preferably 2, 3 or 4, and preferably 3 or 4, of said protrusions. For domestic washing machines, 3 protrusions are most preferred. For commercial washing machines, 5 or 6 protrusions, and preferably 6 protrusions, are most preferred. Where a plurality of elongate protrusions are located on the inner surface of the drum, all of the elongate protrusions typically have the same or substantially the same dimensions as each other. In alternative embodiments, a plurality of elongate protrusions may have elongate protrusions of differing dimensions, i.e. one or more elongate protrusions of a first size and/or shape, and one or more elongate protrusions of a second size and/or shape, etc.

In the apparatus of the present invention, a collecting flow path preferably comprises a collecting aperture which is located in an elongate protrusion at its proximal end.

Optionally, the collecting flow path may further comprise a collecting groove along at least part of an elongate protrusion, wherein the collecting groove is configured to collect solid particulate material during rotation in a collecting direction, whereupon the solid particulate material is biased towards the collecting aperture during further rotation in a collecting direction.

Preferably, a dispensing flow path comprises a dispensing aperture which is located in an elongate protrusion at its distal end or closer to its distal end than its proximal end. A dispensing aperture in an elongate protrusion may alternatively be located from about half way along the elongate protrusion from the proximal end thereof to the distal end thereof. An elongate protrusion may have a plurality of dispensing apertures, which are suitably spaced along the length of the elongate protrusion from its proximal end to its distal end, and such embodiments promote more even distribution of the solid particulate material into the drum.

Preferably, a dispensing flow path is located at least in part in an elongate protrusion.

The elongate protrusion(s) and/or the drum are preferably configured to bias solid particulate material present inside the drum towards the collecting flow path, and particularly towards the end wall, during rotation of the drum in a collecting direction.

In a preferred arrangement, an elongate protrusion is curvilinear and configured to bias said solid particulate material towards a collecting aperture located in the elongate protrusion at its proximal end during rotation of the drum in a collecting direction. A curvilinear elongate protrusion which has a spiral or helical geometry is preferred. It will be appreciated that the term "spiral or helical spiral" geometry" refers to a three dimensional spiral curve which also encompasses an arc of a complete spiral or helical spiral curve.

In a further preferred arrangement, an elongate protrusion is rectilinear.

A drum may comprise both curvilinear and rectilinear elongate protrusions, but typically a drum comprises either curvilinear or rectilinear elongate protrusions.

Preferably, the drum is disposed in the apparatus such that the axis of the drum is substantially horizontal. In a preferred embodiment, the drum is disposed in the apparatus such that the axis of the drum is substantially horizontal during at least part of the operation of the apparatus.

The apparatus and/or drum may also be tiltable (and particularly the drum), as is known in the art, such that the axis of the drum to the horizontal plane can be varied before, during or after the treatment of the substrates in the apparatus, and preferably during the treatment or portion thereof, and particularly during rotation of the drum in a collecting direction. Tilting may be effected by any suitable means, including for instance an air bag, hydraulic ram, pneumatic piston and/or electric motor. In this embodiment, the drum and/or apparatus is tiltable preferably such that the axis of the drum defines an angle A to the horizontal plane which is greater than 0 and less than about 10°. In this embodiment, the drum and/or apparatus is preferably configured to be tiltable such that the drum is inclined in a downwards direction from the front of the drum to the end wall of the drum during at least a part of said treatment, and particularly during rotation of the drum in a collecting direction. Thus, it is preferred that the apparatus is configured such that for at least a part of said treatment (particularly during rotation of the drum in a collecting direction) the axis of the drum is tilted such that it defines an angle A to the horizontal plane which is greater than 0 and less than about 10° and such that the drum is inclined in a downwards direction from the front of the drum to the end wall of the drum.

An apparatus in which the axis of the drum is tiltable is of particular use when the elongate protrusion is rectilinear, such that the bias which encourages solid particulate material present inside the drum towards the collecting flow path, and particularly towards the end wall, during rotation of the drum in a collecting direction is provided by the tilt of the drum.

The use of curvilinear elongate protrusions are of particular utility for apparatus in which the axis of the drum is substantially horizontal, and in particular wherein the axis of the drum is substantially horizontal during operation of the apparatus.

The elongate protrusions may be configured to bias solid particulate material towards a collecting flow path and/or the end wall during rotation of the drum in a collecting direction in ways which are additional or alternative to those described above. Such configurations are described below.

In one preferred embodiment, hereinafter referred to as the "flow-under" embodiment, an elongate protrusion is disposed on the inner surface of the drum such that one or more angled channels are present between the underside of the elongate protrusion and the inner surface of the drum, or are present through an elongate protrusion at one or more position(s) where the elongate protrusion meets the inner surface of the drum so that one boundary wall of the angled channel presents a surface which is continuous with the inner surface of the drum. The angled channels allow the solid particulate material to flow underneath or through the elongate protrusion such that during rotation of the drum in a collecting direction, the exit point of an angled channel is closer to the end-wall of the drum than the entry point of that angled channel. The entry point of an angled channel is located on a first side of an elongate protrusion and the exit point of an angled channel is located on the opposite, second side of an elongate protrusion. The first side of the elongate protrusion is the leading side of the elongate protrusion during rotation of the drum in a collecting direction. During rotation of the drum in a collecting direction, solid particulate material is biased towards an entry point in the first side of a first elongate protrusion, passes through the angled channel, and exits from the exit point in the angled channel on the second side of the first elongate protrusion. In so doing, the solid particulate material becomes closer to the end-wall of the drum and, hence, closer to the collecting pathway present in the next elongate protrusion which said solid particulate material contacts on its trajectory inside the drum during rotation of the drum in a collecting direction, i.e. a second elongate protrusion which is spaced apart from the first elongate protrusion on the inner surface of the drum, thereby improving the collecting efficiency of the solid particulate material. One or more angled channels may be associated with each elongate protrusion, and where a plurality of angled channels are associated with a single elongate protrusion, they may be disposed along all or part of the length of the elongate protrusion. The angled channel is preferably disposed underneath or in the elongate protrusion such that the channel defines an angle with the back-wall of the drum of at least about 10°, preferably at least about 20°, preferably at least about 30°, and no more than about 80°, preferably no more than 70°, preferably no more than about 60°, typically no more than about 50°. Preferably, the angle of the channel is defined herein as a straight line between the entry point and the exit point of the channel. The pathway of the channel may have a rectilinear or curvilinear configuration, and for instance may be straight or curved, and is typically straight. Where the pathway is curved, the channel preferably curves towards the end-wall of the drum. The flow-under embodiment may be used where the rotational axis of the drum is substantially horizontal, inclined or tiltable during operation of the apparatus, but is of particular utility for apparatus in which the rotational axis of the drum is substantially horizontal.

In a further preferred embodiment, hereinafter referred to as the "herringbone" embodiment, an elongate protrusion comprises one or more collecting aperture(s) disposed in a first side thereof at one or more position(s) from the proximal end to the distal end thereof, wherein the first side of the elongate protrusion is the leading side of the elongate protrusion during rotation of the drum in a collecting direction. Preferably, an elongate protrusion comprises a plurality of collecting apertures disposed in the first side thereof. The second side of the elongate protrusion is the trailing side of the elongate protrusion during rotation of the drum in a collecting direction; it will be appreciated that the second side of the elongate protrusion does not comprise collecting apertures. The collecting aperture(s) of this embodiment is/are preferably in addition to said collecting aperture which is located in an elongate protrusion at its proximal end described hereinabove. The collecting aperture(s) of the herringbone embodiment is/are in fluid communication with the collecting flow path via a chain of open compartments which are located in the base or on the underside of the elongate protrusion, and which are configured to bias solid particulate material towards the collecting flow path and storage means during rotation of the drum, particularly during rotation of the drum in a collecting direction. The base of an elongate protrusion is the surface of the elongate protrusion which is juxtaposed with the inner surface of the drum.

In the herringbone embodiment, said chain of open compartments is formed by a first series of vanes and a second series of vanes, wherein said first and second series of vanes are disposed along at least part of the length of the elongate protrusion, wherein said first series of vanes are disposed in an opposing, interlocking but non-contacting and staggered arrangement with said second series of vanes, in a manner to provide a tortuous pathway from the collecting apertures to the collecting flow path.

In the herringbone embodiment, preferably the vanes of the second series are substantially parallel to each other. Preferably, consecutive vanes of said second series are arranged in a U-shape, wherein each U-shape has a distal wall closer to the distal end of the elongate protrusion and a proximal wall closer to the proximal end of the elongate protrusion. Thus, said second series of vanes preferably defines a series of adjoining U-shapes comprising a first U-shape and a second U-shape and optionally one or more subsequent U-shape(s), wherein said first U-shape is closer to the distal end of the elongate protrusion than said second adjoining U-shape, preferably wherein a proximal wall of said first U-shape is the same wall as the distal wall of said adjoining second U-shape. Thus, for instance, the proximal wall of the first U-shape which is nearest the distal end of the elongate protrusion is preferably the same wall as the distal wall of the adjacent, second U-shape which is nearer the proximal end of the elongate protrusion. The second series of vanes is suitably disposed adjacent the second side of the elongate protrusion, preferably such that the base of said U-shape is, or is juxtaposed with, the interior surface of the second side of the elongate protrusion; in other words, the mouth of the U-shape faces inwardly towards the interior of the elongate protrusion and in the direction of rotation of the drum during rotation in a collecting direction. Preferably, said second series of vanes defines a series of inclined adjoining U-shapes wherein the incline of the distal and proximal walls of the U-shape is towards the distal end of the elongate protrusion.

In the herringbone embodiment, preferably the vanes of the first series are arranged in a series of U-shapes wherein each U-shape has a distal wall closer to the distal end of the elongate protrusion and a proximal wall closer to the proximal end of the elongate protrusion. The first series of vanes is suitably disposed adjacent the first side of the elongate protrusion, preferably such that the base of said U-shape is, or is juxtaposed with, the interior surface of the first side of the elongate protrusion; in other words, the mouth of the U-shape faces inwardly towards the interior of the elongate protrusion and in the opposite direction to the rotational direction of the drum during rotation in a collecting direction. Like the second series of vanes, said first series of vanes may define a series of adjoining U-shapes comprising a first U-shape and a second U-shape and optionally one or more subsequent U-shape(s), wherein said first U-shape is closer to the distal end of the elongate protrusion than said second adjoining U-shape, wherein a proximal wall of said first U-shape is the same wall as the distal wall of said adjoining second U-shape. Preferably, however, the first series of vanes defines a series of U-shapes wherein at least one (and preferably each) pair of adjacent U-shapes do not adjoin each other, and wherein at least one (and preferably each) pair of adjacent U-shapes are interrupted by a collecting aperture in the first wall of the elongate protrusion, i.e. there is disposed a collecting aperture in the first wall of the elongate protrusion which separates a pair of adjacent U-shapes. Preferably, a plurality of collecting apertures is disposed in the first wall of the elongate protrusion. In this preferred arrangement, a plurality of collecting apertures in the first side of the elongate protrusion provides multiple entry points into the chain of open compartments and hence multiple entry points to the collecting flow path, thereby significantly improving collection efficiency. Preferably, a U-shape defined by the vanes of the second series comprises a distal wall which is inclined towards the distal end of the elongate protrusion and a proximal wall which is inclined towards the proximal end of the elongate protrusion.

In the herringbone embodiment, it will be appreciated that the series of U-shapes defined by the first series of vanes are disposed in an opposing, interlocking but non-contacting and staggered arrangement with the series of U-shapes defined by the second series of vanes. A U-shape formed by any pair of vanes in either the first or the second series need not be symmetrical, and is typically asymmetrical.

In the herringbone embodiment, during rotation of the drum in a collecting direction, solid particulate material enters a collecting aperture disposed in a first side of an elongate protrusion and is passed into one of the open compartments in the chain of open compartments of the herringbone embodiment, and in particular the solid particulate material is passed into a U-shape formed by the second series of vanes. Upon rotation of the drum in the collecting direction, the solid particulate material is transferred into an opposing and staggered U-shape formed by the first series of vanes, wherein the opposing and staggered U-shape is closer to the proximal end of the elongate protrusion than said U-shape formed by the second series of vanes from which the solid particulate material was transferred. Upon further rotation of the drum in a collecting direction, the solid particulate is passed into a further U-shape formed by the second series of vanes, wherein said further U-shape formed by the second series of vanes is closer to the proximal end of the elongate protrusion than said U-shape formed by the first series of vanes from which the solid particulate material was transferred, and so on. The solid particulate material is thus biased towards the collecting flow path.

The herringbone embodiment may be used where the rotational axis of the drum is substantially horizontal, inclined or tiltable during operation of the apparatus, but is of particular utility for apparatus in which the rotational axis of the drum is substantially horizontal.

The drum, and particularly the inner surface thereof, may also be configured to bias solid particulate material towards the collecting flow path and/or the end wall during rotation of the drum in a collecting direction in ways additional or alternative to those described above. In particular, the inner surface of the drum may be textured or contoured, for instance by virtue of guiding elements affixed thereto or formed integrally therewith, in order to increase the bias of solid particulate material towards the collecting flow path and/or the end-wall of the drum during rotation of the drum in a collecting direction. Such guiding elements are intended, and adapted, to encourage flow of solid particulate material towards the end-wall of the drum and are hence differentiated from the elongate protrusions or lifters, the primary purpose of which is to encourage agitation of the substrates to be treated with the solid particulate material and any treatment agents and/or liquid medium. Accordingly, guiding elements are significantly smaller in depth than elongate protrusions, wherein "depth" refers to the maximum height above or below the inner surface of the drum. Thus, guiding elements which are proud of the inner surface of the drum extend into the interior of the drum much less than elongate protrusions. Preferably, the depth of a guiding element is defined with reference to the longest dimension of the solid particulate material, and preferably the depth of a guiding element has a dimension which is at least as large as the longest dimension of the solid particulate material, preferably at least twice, and preferably no more than about 5 times, preferably no more than about 4 times, the size of the longest dimension of the solid particulate material. Preferably, the depth of a guiding element is no more than 90%, preferably no more than 80%, preferably no more than 70%, preferably no more than 60%, preferably no more than 50%, preferably no more than 40%, preferably no more than 30%, preferably no more than 20% of the depth of an elongate protrusion, and preferably at least 1%, preferably at least 5% of the depth of an elongate protrusion.

One useful embodiment of a guiding element comprises one or more ribs which are disposed on the inner surface of the drum. In a further useful embodiment, a guiding element comprises one or more grooves which are disposed in the inner surface of the drum. Where one or more elongate protrusions are disposed on the inner surface of the drum then said one or more rib(s) and/or said one or more groove(s) are preferably disposed between adjacent elongate protrusions.

Advantageously, the ribs or grooves are angled in a manner which directs solid particulate material away from the front of the drum (and where present away from a first elongate protrusion) and towards the end-wall of the drum (and where present towards a second elongate protrusion spaced apart from said first elongate protrusion) during rotation of the drum in a collecting direction. The ribs or grooves may extend across the inner surface for the whole or part of the distance between adjacent elongate protrusions, but typically the ribs or grooves extend across the inner surface for only part of the distance between adjacent elongate protrusions, and typically from about 5% to about 95%, or from about 10% to about 80%, of the distance between adjacent elongate protrusions. Thus, the ribs or grooves bias the solid particulate material towards the end wall during rotation of the drum in a collecting direction. The ribs or grooves are disposed at an angle to the end walls (and where elongate protrusions are present, at an angle to the elongate protrusions) which is neither parallel nor perpendicular thereto. In particular, the ribs or grooves are disposed such that the leading end of a rib or groove during rotation of the drum in a collecting direction is closer to the front of the drum than the trailing end of said rib or groove during rotation of the drum in a collecting direction. A rib or groove preferably defines an angle with the end wall of the drum of at least about 10°, preferably at least about 20°, preferably at least about 30°, and no more than about 80°, preferably no more than 70°, preferably no more than about 60°, typically no more than about 50°. Preferably, the angle of the rib or groove is defined herein as a straight line between the start of the rib or groove and the end of the rib or groove. The ribs or grooves on or in the inner surface of the drum may define a straight or curved pathway. It will be appreciated that the inner surface of a cylindrical drum is curved, and so reference herein to a "straight pathway" will be understood as a pathway which follows the curvature of the surface of the drum in a linear manner between two points on said curved inner surface of the drum, and reference herein to a "curved pathway" will be understood as a pathway which follows the curvature of the inner surface of the drum and which is also curved in a further dimension across the inner surface of the drum. Where the pathway is a curved pathway, the rib or groove preferably curves towards the end-wall of the drum. A combination of rib(s) and groove(s) may be used. A plurality of ribs and/or a plurality of grooves may be disposed across an area of the inner surface of the drum which is bounded by the front of the drum and the end-wall of the drum and, where elongate protrusions are present, across an area of the inner surface of the drum which is at least partially bounded by adjacent elongate protrusions. It is preferred that the ribs disclosed in this embodiment are either unperforated or contain no perforations therein which are as big as any dimension of the solid particulate material.

In the aforementioned rib embodiment, the profile of the rib is preferably configured to retain solid particulate material during the biasing thereof towards the end-wall of the drum. Thus, it is preferred that the edge of the rib which is the leading edge during rotation of the drum in a collecting direction comprises a collecting groove which runs at least partially along the length of the rib, and preferably along substantially the whole length of the rib.

A further useful embodiment of a guiding element is a perforated diverting rib disposed on the inner surface of the drum, preferably between adjacent elongate protrusions. A perforated diverting rib is preferably disposed on the inner surface of the drum such that it extends in a direction away from the end-wall of the drum and towards the front of the drum. In other words, a perforated diverting rib generally extends in a direction which is substantially parallel with the rotational axis of the drum and/or substantially parallel with the elongate protrusions. A perforated diverting rib is defined by a first edge which is the leading edge during rotation of the drum in a collecting direction, and a second edge which is the trailing edge during rotation of the drum in a collecting direction. Each of the first and second edges has one or more apertures therein. The perforated diverting rib comprises a plurality of angled channels which connect the aperture(s) on the first edge with the aperture(s) on the second edge. Where the perforated diverting rib meets the inner surface of the drum, the aperture(s) and angled channels are preferably disposed such that one boundary wall of the angled channel (i.e. the base of the channel) presents a surface which is continuous with the inner surface of the drum. These angled channels work on the same principle as the angled channels of the "flow-under" embodiment described hereinabove. The exit point from an angled channel at the second edge of the rib is closer to the end-wall of the drum than the entry point into that angled channel at the first edge of the rib, thereby allowing solid particulate material to flow through the perforated diverting rib so that during rotation of the drum in a collecting direction the solid particulate material is biased towards the end-wall of the drum, thereby improving the collecting efficiency of the solid particulate material. The plurality of angled channels may be disposed along all or part of the length of a perforated diverting rib. The angled channel preferably defines an angle with the back-wall of the drum of at least about 10°, preferably at least about 20°, preferably at least about 30°, and no more than about 80°, preferably no more than 70°, preferably no more than about 60°, typically no more than about 50°. Preferably, the angle of a channel is defined herein as a straight line between the entry point and the exit point of that channel. The pathway of a channel may have a rectilinear or curvilinear configuration, and for instance may be straight or curved, and is typically straight. Where the pathway is curved, the channel preferably curves towards the end-wall of the drum. A perforated diverting rib may be used where the rotational axis of the drum is substantially horizontal, inclined or tiltable during operation of the apparatus, but is of particular utility for apparatus in which the rotational axis of the drum is substantially horizontal.

In the apparatus of the present invention, the storage means and/or any elongate protrusion(s) are preferably configured to bias solid particulate material present inside the storage means towards the dispensing flow path during rotation of the drum in a dispensing direction. Where the apparatus comprises an elongate protrusion with a dispensing aperture located in the at least one elongate protrusion at its distal end or closer to its distal end than its proximal end, then said storage means and/or elongate protrusion(s) are preferably configured to bias solid particulate material present inside the storage means and/or dispensing flow path towards said dispensing aperture in an elongate protrusion during rotation of the drum in a dispensing direction.

Preferably, the dispensing flow path may be described as generally comprising a chain of open compartments located in the elongate protrusion and configured to bias solid particulate material present inside the storage means and/or dispensing flow path towards said dispensing aperture during in an elongate protrusion rotation of the drum in a dispensing direction.

In a preferred embodiment, the dispensing flow path comprises an Archimedean screw arrangement which is located in the elongate protrusion. As the drum is rotated in the dispensing direction, the solid particulate material within the dispensing flow path is urged by the internal surfaces of the Archimedean screw along the dispensing flow path and towards the dispensing aperture, and then into the interior of the drum. Thus, as a result only of the rotation of the drum, the particulate material may be conveyed from the storage means back to the interior of the drum. In one embodiment, the Archimedean screw may be motorised but preferably the inner surfaces of the Archimedean screw are static, relative to the inner wall of the drum, i.e. the inner surfaces of the Archimedean screw preferably do not rotate independently of the rotation of the drum.

The inner surfaces of the Archimedean screw suitably have a conventional circular and/or smooth arrangement. Alternatively or additionally, the Archimedean screw is rectilinear, having stepped surfaces along at least a part of its length. Similarly, while the cross-section of an Archimedean screw is suitably circular, other cross-sections are envisaged, and particularly multi-lobal cross-sections, such as tri-lobal or quadri-lobal. A trilobal cross-section is of particular utility because the elongate protrusions within which the Archimedean screw is disposed are typically triangular in cross-section; hence a trilobal cross-section for the Archimedean screw makes the best possible use of the space available inside the elongate protrusion.

In another preferred embodiment, referred to herein as the paternoster configuration, the dispensing flow path suitably comprises a chain of open compartments located in the elongate protrusion, wherein said open compartments are formed by a first series of inclined vanes substantially parallel to each other and a second series of inclined vanes substantially parallel to each other, wherein said first and second series are disposed along at least part of the length of the interior of the elongate protrusion, wherein said first series of vanes are disposed in a facing arrangement to said second series of vanes, wherein said first series of vanes are not parallel to said second series of vanes, and wherein the compartments and vanes are configured to bias solid particulate material present inside the storage means and/or dispensing flow path towards said dispensing aperture in an elongate protrusion during rotation of the drum in a dispensing direction.

In a further preferred embodiment, a dispensing flow path comprises opposing and offset saw-tooth surfaces configured to bias solid particulate material present inside the storage means and/or dispensing flow path towards said dispensing aperture located in an elongate protrusion during rotation of the drum in a dispensing direction.

Rectilinear arrangements for the dispensing flow path in the elongate protrusion are of particular utility because the elongate protrusion may be manufactured in multiple pieces and assembled together to form the dispensing flow path in the elongate protrusion.

In a further preferred embodiment, and where the apparatus comprises elongate protrusion(s) having a dispensing aperture located in said elongate protrusion at its distal end or closer to its distal end than its proximal end such that the elongate protrusion(s) are configured to bias solid particulate material present inside the dispensing flow path towards said dispensing aperture during rotation of the drum in a dispensing direction, and particularly where the apparatus comprises curvilinear (such as spiral or helical) elongate protrusions, the dispensing flow path may simply be a hollow cavity inside the elongate protrusion. In such embodiments, the shape of the elongate protrusion and the dispensing cavity facilitates the movement of the solid particulate material towards the dispensing aperture during rotation of the drum in a dispensing direction.

The storage means may take a variety of forms and the drum may comprise storage means at one or more locations. In a preferred embodiment, the storage means comprises multiple compartments, for instance, 2, 3, 4, 5 or 6 compartments, particularly wherein said multiple compartments are arranged so as to retain balance of the drum during rotation.

The capacity of the storage means will vary with the size of the drum and the amount of solid particulate material. Preferably the capacity of the storage means is from about 20 to about 50%, preferably from about 30 to about 40%, larger than the volume of the solid particulate material. Thus, a washing machine for domestic use would typically require about 8 litres of solid particulate material, and an appropriate storage means for such a machine has a capacity of about 11 litres.

The storage means may be or may comprise at least one cavity located in an elongate protrusion.

In one particularly useful embodiment, the storage means and the elongate protrusions can be assembled together inside the drum and/or are able to be retrofitted to an existing drum. This arrangement is of particular utility in converting a conventional apparatus which is not suitable or adapted for the treatment of substrates using a solid particulate material into an apparatus which is suitable for the treatment of substrates using a solid particulate material. In this embodiment, the storage means and the elongate protrusions would normally be non-integral elements, in order to allow these components to be introduced into the drum without dissembling the whole apparatus. However, integral storage means and elongate protrusions are also envisaged.

In a further particularly useful embodiment, the storage means and the elongate protrusions are removable and replaceable, either by the consumer or by a service engineer, allowing the solid particulate material contained therein to be easily replaced, as required, with fresh solid particulate material. In this embodiment, the storage means and the elongate protrusions would normally be non-integral elements, in order to allow these components to be introduced into the drum without dissembling the whole apparatus. However, integral storage means and elongate protrusions are also envisaged.

In a particularly preferred embodiment, at least part of (and preferably all of) the storage means is or comprises at least one cavity located in the end wall of the drum. It will be appreciated that the term "located in the end wall of the drum" describes a storage means which is integral with, or affixed or disposed on, any part of the structure of the end wall. Thus, in the retro-fitting embodiment described hereinbelow (including, for instance, FIG. 6), the storage means are disposed or affixed onto the existing end wall of an existing drum. The outer surface of the retrofitted storage means which faces towards the interior of the drum thus creates a new interior surface, which is different to the original interior surface of the original end wall prior to retro-fitting, but it will be appreciated that this new interior surface is treated for the purposes of this invention as being the interior surface of the new end wall of the drum. In other words, the retro-fitted storage means becomes part of the element which is described herein as the "end wall of the drum". Similarly, storage means may be also present on or retro-fitted to the exterior surface of an end wall of the drum which faces the casing of the apparatus, and for the purposes of the present invention such a storage means is also treated as "located in the end wall of the drum".

Thus, the storage means may be or comprise at least one spiral or helical pathway located in the end wall of the drum.

In another preferred embodiment, the storage means is or comprises a toroidal cavity located at the juncture of the inner surface and end wall of the drum, or wherein the storage means is or comprises a cavity having a shape defined by a toroidal segment located at the juncture of said inner surface and said end wall. It will be appreciated that such a storage means does not fall within the meaning of "located in the end wall of the drum" as used herein.

The storage means may comprise multiple parts, preferably 2, 3 or 4 parts, which advantageously can be assembled inside the drum and/or which is able to be retrofitted to an existing drum.

In a particularly preferred embodiment, the storage means comprises multiple compartments or cavities located in the end wall of the drum, as described above. Preferably, each of the compartments in such a multi-compartment arrangement is defined by a cavity bound by a first wall and a second wall which each extend substantially radially outwards from the rotational axis of the drum towards, and preferably extends to, the inner wall of the drum. The drum is normally cylindrical, and so preferably each compartment substantially defines a sector of a cylindrical storage volume in the end wall of drum. Preferably, each compartment in the multi-compartment arrangement is adjacent another compartment, preferably so that the compartments define adjacent such sectors which fill or substantially fill a cylindrical storage volume in the end wall of drum. As used herein, the terms "extend substantially radially outwards" and "substantially defines a sector" means that said first wall and/or said second wall of said cavity need not follow a straight line defining the mathematical radius, i.e. a straight line extending radially outwards from the rotational axis towards and preferably to the inner wall of the drum, but said first wall and/or said second wall of said cavity may also follow a curvilinear path which extends outwards from the rotational axis of the drum towards and preferably to the inner wall of the drum. Preferably, each compartment in the multi-compartment arrangement is associated with a single dispensing flow path and a single collecting flow path. Preferably, each compartment in the multi-compartment arrangement is associated with a single lifter as described hereinabove.

In the multi-compartment embodiment, it is preferred that at least one pair of adjacent compartments are in fluid communication. Preferably, each compartment is in fluid communication with its adjacent compartment or compartments. As used herein, the term "fluid communication" means that solid particulate material, as well as any liquid medium, is able to pass from one compartment directly into an adjacent compartment or compartments during rotation of the drum. Surprisingly, such an arrangement advantageously minimises or avoids the tendency for aggregation of solid particulate material which has been contacted with the liquid medium, i.e. it minimises or avoids the tendency of moist or wet solid particulate material to aggregate or clump together in the storage means, which can cause at least partial blockage of the collecting flow path and/or the dispensing flow path, particularly of the collecting flow path (particularly when said collecting flow path comprises a valve as described hereinbelow). Such an arrangement also provides a surprising improvement in the collection efficiency of the solid particulate material. Such an arrangement advantageously creates more space in the storage means at the point(s) where the storage means meet the collecting and/or dispensing flow paths. Such an arrangement can also advantageously improve the balance of the drum during rotation. The fluid communication between adjacent compartments is preferably effected by an aperture, hereinafter referred to as a communicating aperture, in the wall between adjacent compartments. Such a communicating aperture preferably exhibits a smallest dimension which is at least 4 times greater than the longest dimension of the solid particulate material. The largest dimension of the communicating aperture is suitably appropriate to retain the individual nature of the compartments and, as such, the largest dimension of the communicating aperture is preferably no greater than 50%, preferably no greater than 40%, preferably no greater than 30%, preferably no greater than 20%, and typically no greater than 15%, of the longest dimension of a wall between adjacent compartments. A communicating aperture is preferably located in a wall between adjacent compartments approximately midway between the rotational axis and the inner wall of the drum. As used herein, the term "approximately midway" means any position along a wall between adjacent compartments that is closer to the mid-point of said wall between adjacent compartments than to either the rotational axis of the drum or the inner wall of the drum. For instance, where each compartment defines a sector of a cylindrical storage volume in the end wall of the drum, the mid-point of a wall between adjacent compartments is half the radius of the drum. Preferably, a communicating aperture in a wall between adjacent compartments is located at said mid-point.

Suitably, the storage means further comprises one or more perforations which have dimensions smaller than the dimensions of the solid particulate material so as to permit passage of fluids through said perforations into and out of the storage means, particularly from the interior of said drum, but to prevent egress of said solid particulate material through said perforations. The presence of such perforations is advantageous for the cleaning and general hygiene of the interior of the storage means.

Optionally, the elongate protrusions described herein may further comprise one or more perforations which have dimensions smaller than the dimensions of the solid particulate material so as to permit passage of fluids through said perforations but to prevent passage of said solid particulate material through said perforations.

In the apparatus of the present invention, at least a portion of the collecting flow path may be juxtaposed with at least a portion of the dispensing flow path, wherein said juxtaposed potions are separated by a deflector wall which helps to prevent egress of said solid particulate material from said storage means to the interior of said drum via said collecting flow path and/or which assists in biasing the particles towards the dispensing path.

The collecting flow path preferably comprises a valve, preferably a one-way flap valve, to prevent egress of said solid particulate material from said storage means to the interior of said drum via said collecting flow path. Advantageously, such a valve helps ensure the storage means is filled as efficiently as possible. The flap valve may be biased with a spring, and/or be mechanically controlled with a cam, and/or be gravity-operated and comprise therein a sufficient weight, in order to prevent egress of solid particulate material from said storage means to the interior of said drum via said collecting flow path.

The dispensing flow path is preferably configured such that it dispenses solid particulate material from a dispensing aperture therein when the dispensing aperture is above the horizontal plane bisecting the axis of drum rotation, preferably such that the solid particulate material falls on to the substrate(s).

The dimensions of said storage means, and said dispensing and collecting flow paths are preferably such that they have no internal dimension which is less than at least 2 times, more preferably less than at least 3 times, more preferably less than at least 4 times, the longest dimension of the solid particulate material. The internal dimensions of the angled channels of the afore-mentioned flow-under embodiment, the perforated diverting rib embodiment, and the chain of open compartments of the herringbone embodiment are preferably similarly sized. Such dimensions help to maintain the particle flow and the speed thereof, as well as preventing blockages.

In a preferred embodiment, the inner surface of the rotatably mounted drum is configured to bias solid particle material towards the end wall of the drum. In a preferred embodiment, the inner surface of the drum is inclined such that the surface of the drum defines an angle A' to the horizontal plane which is greater than 0 and less than about 20°, preferably at least about 1°, preferably at least about 5°, preferably from 1 to 20°, preferably from 1 to 10°, preferably from 5 to 10°. In this embodiment, the inner surface of the drum is inclined in a downwards direction from the front of the drum to the end wall of the drum. Thus, the inner surface of the drum defines a frusto-conical surface. The frusto-conical surface thus has a diameter at the front of the apparatus which is smaller than the diameter thereof at the end wall of the drum. It will be appreciated that this embodiment is of particular utility wherein the drum is disposed in the apparatus such that the rotational axis of the drum is substantially horizontal, for instance wherein the drum and/or apparatus is non-tiltable. It will be further be appreciated that this embodiment is of particular utility in arrangements wherein the collecting flow path comprises a collecting aperture which is located in an elongate protrusion (or "lifter") at its proximal end.

In the afore-mentioned frusto-conical surface embodiment, the inner surface of the drum is preferably configured to define at least one collecting channel in the inner surface at the juncture of the inner surface and the end-wall of the drum. Said collecting channel extends at least partially around the perimeter of the end-wall of the drum. This embodiment is of particular utility in arrangements wherein the collecting flow path comprises a collecting aperture which is located in an elongate protrusion (or "lifter") at its proximal end, and in such arrangements the inner surface of the drum is preferably configured to define such a collecting channel located at the juncture of the inner surface and the end-wall of the drum between each elongate protrusion. The collecting channel extends along the juncture of the inner surface and the end-wall of the drum to the collecting aperture, and is thus configured to bias solid particulate material towards the collecting aperture during rotation of the drum in a collecting direction. The presence of said at least one collecting channel is advantageous because it improves the collection efficiency of solid particulate material during rotation of the drum in a collecting direction, providing further biasing of the solid particulate material towards the collecting aperture during rotation in a collecting direction.

In the frusto-conical surface embodiment, the surface may optionally comprise one or more perforations which have dimensions smaller than the dimensions of the solid particulate material so as to permit passage of fluids through said perforations but to prevent passage of said solid particulate material through said perforations.

In a particularly useful embodiment, a frusto-conical inner surface may be assembled inside the drum and/or is able to be retrofitted to an existing drum, particularly where the apparatus comprises a drum in which the rotational axis is fixed in the horizontal plane. This embodiment is of particular utility in converting a conventional apparatus which is not suitable or adapted for the treatment of substrates using a solid particulate material into an apparatus which is suitable for the treatment of substrates using a solid particulate material. Such a frusto-conical surface is preferably provided as a plurality of inserts which may be disposed on the existing surface (typically a cylindrical surface) of the drum of the conventional apparatus. Such a frusto-conical surface is suitably used in combination with the retrofittable storage means and elongate protrusions described hereinabove, and would typically be provided as a non-integral element thereto in order to allow the components to be introduced into the drum without dissembling the whole apparatus.

The apparatus of the present invention is preferably configured for the treatment of substrates with solid particulate material in the presence of a liquid medium and/or one of more treatment formulation(s).

The solid particulate material preferably comprises a multiplicity of particles. Typically, the number of particles is no less than 1000, more typically no less than 10,000, even more typically no less than 100,000. A large number of particles is particularly advantageous in preventing creasing and/or for improving the uniformity of treating or cleaning of the substrate, particularly wherein the substrate is a textile.

Preferably, the particles have an average mass of from about 1 mg to about 1000 mg, or from about 1 mg to about 700 mg, or from about 1 mg to about 500 mg, or from about 1 mg to about 300 mg, preferably at least about 10 mg, per particle. In one preferred embodiment, the particles preferably have an average mass of from about 1 mg to about 150 mg, or from about 1 mg to about 70 mg, or from about 1 mg to about 50 mg, or from about 1 mg to about 35 mg, or from about 10 mg to about 30 mg, or from about 12 mg to about 25 mg. In an alternative embodiment, the particles preferably have an average mass of from about 10 mg to about 800 mg, or from about 20 mg to about 700 mg, or from about 50 mg to about 700 mg, or from about 70 mg to about 600 mg from about 20 mg to about 600 mg. In one preferred embodiment, the particles have an average mass of about 25 to about 150 mg, preferably from about 40 to about 80 mg. In a further preferred embodiment, the particles have an average mass of from about 150 to about 500 mg, preferably from about 150 to about 300 mg.

The average volume of the particles is preferably in the range of from about 5 to about 500 $mm^3$, from about 5 to about 275 $mm^3$, from about 8 to about 140 $mm^3$, or from about 10 to about 120 $mm^3$, or at least 40 $mm^3$, for instance from about 40 to about 500 $mm^3$, or from about 40 to about 275 $mm^3$, per particle.

The average surface area of the particles is preferably from 10 $mm^2$ to 500 $mm^2$ per particle, preferably from 10 $mm^2$ to 400 $mm^2$, more preferably from 40 to 200 $mm^2$ and especially from 50 to 190 $mm^2$.

The particles preferably have an average particle size of at least 1 mm, preferably at least 2 mm, preferably at least 3 mm, preferably at least 4 mm, and preferably at least 5 mm. The particles preferably have an average particle size no more than 100 mm, preferably no more than 70 mm, preferably no more than 50 mm, preferably no more than 40 mm, preferably no more than 30 mm, preferably no more than 20 mm, preferably no more than 10 mm, and optionally no more than 7 mm. Preferably, the particles have an average particle size of from 1 to 20 mm, more preferably from 1 to 10 mm. Particles which offer an especially prolonged effectiveness over a number of treatment cycles are those with an average particle size of at least 5 mm, preferably from 5 to 10 mm. The size is preferably the largest linear dimension (length). For a sphere this equates to the diameter. For non-spheres this corresponds to the longest linear dimension. The size is preferably determined using Vernier callipers. The average particle size is preferably a number average. The determination of the average particle size is preferably performed by measuring the particle size of at least 10, more preferably at least 100 particles and especially at least 1000 particles. The above mentioned particle sizes provide especially good performance (particularly cleaning performance) whilst also permitting the particles to be readily separable from the substrate at the end of the treatment method.

The particles preferably have an average particle density of greater than 1 $g/cm^3$, more preferably greater than 1.1 $g/cm^3$, more preferably greater than 1.2 $g/cm^3$, even more preferably at least 1.25 $g/cm^3$, even more preferably greater than 1.3 $g/cm^3$, and even more preferably greater than 1.4 $g/cm^3$. The particles preferably have an average particle density of no more than 3 $g/cm^3$ and especially no more than 2.5 $g/cm^3$. Preferably, the particles have an average density of from 1.2 to 3 $g/cm^3$. These densities are advantageous for further improving the degree of mechanical action which assists in the treatment process and which can assist in permitting better separation of the particles from the substrate after the treatment.

The particles of the solid particulate material may be polymeric and/or non-polymeric particles. Suitable non-polymeric particles may be selected from metal, alloy, ceramic and glass particles. Preferably, however, the particles of the solid particulate material are polymeric particles.

Preferably the particles comprise a thermoplastic polymer. A thermoplastic polymer, as used herein, preferably means a material which becomes soft when heated and hard when cooled. This is to be distinguished from thermosets (e.g. rubbers) which will not soften on heating. A more preferred thermoplastic is one which can be used in hot melt compounding and extrusion.

The polymer preferably has a solubility in water of no more than 1 wt %, more preferably no more than 0.1 wt % in water and most preferably the polymer is insoluble in water. Preferably the water is at pH 7 and a temperature of 20° C. whilst the solubility test is being performed. The solubility test is preferably performed over a period of 24 hours. The polymer is preferably not degradable. By the words "not degradable" it is preferably meant that the polymer is stable in water without showing any appreciable tendency to dissolve or hydrolyse. For example, the polymer shows no appreciable tendency to dissolve or hydrolyse over a period of 24 hrs in water at pH 7 and at a temperature of 20° C. Preferably a polymer shows no appreciable tendency to dissolve or hydrolyse if no more than about 1 wt %, preferably no more than about 0.1 wt % and preferably none of the polymer dissolves or hydrolyses, preferably under the conditions defined above.

The polymer may be crystalline or amorphous or a mixture thereof.

The polymer can be linear, branched or partly cross-linked (preferably wherein the polymer is still thermoplastic in nature), more preferably the polymer is linear.

The polymer preferably is or comprises a polyalkylene, a polyamide, a polyester or a polyurethane and copolymers and/or blends thereof, preferably from polyalkylenes, polyamides and polyesters, preferably from polyamides and polyalkylene, and preferably from polyamides.

A preferred polyalkylene is polypropylene.

A preferred polyamide is or comprises an aliphatic or aromatic polyamide, more preferably an aliphatic polyamide. Preferred polyamides are those comprising aliphatic chains, especially $C_4$-$C_{16}$, $C_4$-$C_{12}$ and $C_4$-$C_{10}$ aliphatic chains. Preferred polyamides are or comprise Nylons. Preferred Nylons include Nylon 4,6, Nylon 4,10, Nylon 5, Nylon 5,10, Nylon 6, Nylon 6,6, Nylon 6/6,6, Nylon 6,6/6, 10, Nylon 6,10, Nylon 6,12, Nylon 7, Nylon 9, Nylon 10, Nylon 10,10, Nylon 11, Nylon 12, Nylon 12,12 and copolymers or blends thereof. Of these, Nylon 6, Nylon 6,6 and Nylon 6,10, and particularly Nylon 6 and Nylon 6,6, and copolymers or blends thereof are preferred. It will be appreciated that these Nylon grades of polyamides are not degradable, wherein the word degradable is preferably as defined above.

Suitable polyesters may be aliphatic or aromatic, and preferably derived from an aromatic dicarboxylic acid and a $C_1$-$C_6$, preferably $C_2$-$C_4$ aliphatic diol. Preferably, the aromatic dicarboxylic acid is selected from terephthalic acid, isophthalic acid, phthalic acid, 1,4-, 2,5-, 2,6- and 2,7-naphthalenedicarboxylic acid, and is preferably terephthalic acid or 2,6-naphthalenedicarboxylic acid, and is most preferably terephthalic acid. The aliphatic diol is preferably ethylene glycol or 1,4-butanediol. Preferred polyesters are selected from polyethylene terephthalate and polybutylene terephthalate. Useful polyesters can have a molecular weight corresponding to an intrinsic viscosity measurement in the range of from about 0.3 to about 1.5 dl/g, as measured by a solution technique such as ASTM D-4603.

Preferably, polymeric particles comprise a filler, preferably an inorganic filler, suitably an inorganic mineral filler in particulate form, such as $BaSO_4$. The filler is preferably present in the particle in an amount of at least 5 wt %, more preferably at least 10 wt %, even more preferably at least 20 wt %, yet more preferably at least 30 wt % and especially at least 40 wt % relative to the total weight of the particle. The filler is typically present in the particle in an amount of no more than 90 wt %, more preferably no more than 85 wt %, even more preferably no more than 80 wt %, yet more preferably no more than 75 wt %, especially no more than 70 wt %, more especially no more than 65 wt % and most especially no more than 60 wt % relative to the total weight of the particle. The weight percentage of filler is preferably established by ashing. Preferred ashing methods include ASTM D2584, D5630 and ISO 3451, and preferably the test method is conducted according to ASTM D5630. For any standards referred to in the present invention, unless specified otherwise, the definitive version of the standard is the most recent version which precedes the priority filing date of this patent application. Preferably, the matrix of said polymer optionally comprising filler(s) and/or other additives extends throughout the whole volume of the particles.

The particles can be spheroidal or substantially spherical, ellipsoidal, cylindrical or cuboid. Particles having shapes which are intermediate between these shapes are also possible. The best results for treatment performance (particularly cleaning performance) and separation performance (separating the substrate from the particles after the treating steps) in combination are typically observed with ellipsoidal particles. Spheroidal particles tend to separate best but may not provide optimum treatment or cleaning performance. Conversely, cylindrical or cuboid particles separate poorly but treat or clean effectively. Spherical and ellipsoidal particles are particularly useful where improved fabric care is important because they are less abrasive. Spheroidal or ellipsoidal particles are particularly useful in the present invention which is designed to operate without a particle pump and wherein the transfer of the particles between the storage means and the interior of the drum is facilitated by rotation of the drum.

The term "spheroidal", as used herein, encompasses spherical and substantially spherical particles. Preferably, the particles are not perfectly spherical. Preferably, the particles have an average aspect ratio of greater than 1, more preferably greater than 1.05, even more preferably greater than 1.07 and especially greater than 1.1. Preferably, the particles have an average aspect ratio of less than 5, preferably less than 3, preferably less than 2, preferably less than 1.7 and preferably less than 1.5. The average is preferably a number average. The average is preferably performed on at least 10, more preferably at least 100 particles and especially at least 1000 particles. The aspect ratio for each particle is preferably given by the ratio of the longest linear dimension divided by the shortest linear dimension. This is preferably measured using Vernier Callipers. Where a good balance between treating performance (particularly cleaning performance) and substrate care is required, it is preferred that the average aspect ratio is within the abovementioned values. When the particles have a very low aspect ratio (e.g. highly spherical particles), the particles may not provide sufficient mechanical action for good treating or cleaning characteristics. When the particles have an aspect ratio which is too high, the removal of the particles from the substrate may become more difficult and/or the abrasion on the substrate may become too high, which may lead to unwanted damage to the substrate, particularly wherein the substrate is a textile.

According to a further aspect of the present invention, there is provided a method for treating a substrate, the method comprising agitating the substrate with solid particulate material in the apparatus of the present invention, as described herein.

Preferably, in the method of the present invention, the solid particulate material is re-used in further treatment procedures.

Preferably the method additionally comprises separating the particles from the treated substrate. The particles are preferably stored in the storage means for use in the next treatment procedure.

Preferably the method comprises rotating the drum for multiple rotations in said dispensing direction and further comprises rotating the drum for multiple rotations in said collecting direction.

It will be appreciated that during the step of agitating the substrate with solid particulate material, the drum rotates for multiple rotations in said dispensing direction, and may also rotate for multiple rotations in said collecting direction. Rotation in both directions during the agitating phase may be preferable in order to facilitate circulation of the solid particulate material through the drum and storage means. Preferably, however, the agitating phase comprises a greater number of rotations in the dispensing direction than in the collecting direction.

It will also be appreciated that during the step of separating the particles from the treated substrate, the drum rotates for multiple rotations in said collecting direction, and may also rotate for multiple rotations in said dispensing direction. Rotation in both directions during the separating phase may be advantageous in order to facilitate better separation of the solid particulate material from the treated substrate. Preferably, however, the separating phase comprises a greater number of rotations in the collecting direction than in the dispensing direction.

The method preferably comprises agitating the substrate with solid particulate material and a liquid medium. Preferably, the method comprises agitating the substrate with said solid particulate material and a treatment formulation. Preferably, the method comprises agitating the substrate with said solid particulate material, a liquid medium and one or more treatment formulation(s).

The method may comprise the additional step of rinsing the treated substrate. Rinsing is preferably performed by adding a rinsing liquid medium, optionally comprising one or more post-treatment additives, to the treated substrate. The rinsing liquid medium is preferably an aqueous medium as defined herein.

Thus, preferably, the method is a method for treating multiple batches, wherein a batch comprises at least one substrate, the method comprising agitating a first batch with solid particulate material, wherein said method further comprises the steps of:

(a) collecting said solid particulate material in the storage means;

(b) agitating a second batch comprising at least one substrate with solid particulate material collected from step (a); and (c) optionally repeating steps (a) and (b) for subsequent batch(es) comprising at least one substrate.

The treatment procedure of an individual batch typically comprises the steps of agitating the batch with said solid particulate material in a treatment apparatus for a treatment cycle. A treatment cycle typically comprises one or more discrete treatment step(s), optionally one or more rinsing step(s), optionally one or more step(s) of separating the particles from the treated batch, optionally one or more extraction step(s) of removing liquid medium from the treated batch, optionally one or more drying step(s), and optionally the step of removing the treated batch from the apparatus.

In the method of the present invention, steps (a) and (b) may be repeated at least 1 time, preferably at least 2 times, preferably at least 3 times, preferably at least 5 times, preferably at least 10 times, preferably at least 20 times, preferably at least 50 times, preferably at least 100 times, preferably at least 200 times, preferably at least 300 times, preferably at least 400 at least or preferably at least 500 times.

The substrate may be or comprise a textile and/or an animal skin substrate. In a preferred embodiment, the substrate is or comprises a textile. The textile may be in the form of an item of clothing such as a coat, jacket, trousers, shirt, skirt, dress, jumper, underwear, hat, scarf, overalls, shorts, swim wear, socks and suits. The textile may also be in the form of a bag, belt, curtains, rug, blanket, sheet or a furniture covering. The textile can also be in the form of a panel, sheet or roll of material which is later used to prepare the finished item or items. The textile can be or comprise a synthetic fibre, a natural fibre or a combination thereof. The textile can comprise a natural fibre which has undergone one or more chemical modifications. Examples of natural fibres include hair (e.g. wool), silk and cotton. Examples of synthetic textile fibres include Nylon (e.g. Nylon 6,6), acrylic, polyester and blends thereof. As used herein, the term "animal skin substrate" includes skins, hides, pelts, leather and fleeces. Typically, the animal skin substrate is a hide or a pelt. The hide or pelt may be a processed or unprocessed animal skin substrate.

The treating of a substrate which is or comprises a textile according to the present invention may be a cleaning process or any other treatment process such as coloration (preferably dyeing), ageing or abrading (for instance stone-washing), bleaching or other finishing process. Stonewashing is a known method for providing textiles having "worn in" or "stonewashed" characteristics such as a faded appearance, a softer feel and a greater degree of flexibility. Stonewashing is frequently practiced with denim. Preferably the treating of a substrate which is or comprises a textile is a cleaning process. The cleaning process may be a domestic or industrial cleaning process.

As used herein, the term "treating" in relation to treating an animal skin substrate is preferably a tannery process, including colouring and tanning and associated tannery processes, preferably selected from curing, beamhouse treatments, pre-tanning, tanning, re-tanning, fat liquoring, enzyme treatment, tawing, crusting, dyeing and dye fixing, preferably wherein said beamhouse treatments are selected from soaking, liming, deliming, reliming, unhairing, fleshing, bating, degreasing, scudding, pickling and depickling. Preferably, said treating of an animal skin substrate is a process used in the production of leather. Preferably, said treating acts to transfer a tanning agent (including a colourant or other agent used in a tannery process) onto or into the animal skin substrate.

The treatment formulation referred to herein may comprise one or more treatment agent(s) which are suitable to effect the desired treating of the substrate.

Thus, a method according to the present invention which is a cleaning process suitably comprises agitating the substrate with said solid particulate material, a liquid medium and one or more treatment formulation(s) wherein said treatment formulation is preferably a detergent composition comprising one or more of the following components: surfactants, dye transfer inhibitors, builders, enzymes, metal chelating agents, biocides, solvents, stabilizers, acids, bases and buffers.

Similarly, the treatment formulation of a coloration process is preferably a composition comprising one or more dyes, pigments, optical brighteners and mixtures thereof.

The treatment formulation of a stone-washing process may comprise an appropriate stone-washing agent, as known in the art, for instance an enzymatic treatment agent such as a cellulase.

The treatment formulation of a tannery process suitably comprises one or more agent(s) selected from tanning agents, re-tanning agents and tannery process agents. The treatment formulation may comprise one or more colourant (s). The tanning or re-tanning agent is preferably selected from synthetic tanning agents, vegetable tanning or vegetable re-tanning agents and mineral tanning agents such as chromium (III) salts or salts and complexes containing iron, zirconium, aluminium and titanium. Suitable synthetic tanning agents include amino resins, polyacrylates, fluoro and/or silicone polymers and formaldehyde condensation polymers based on phenol, urea, melamine, naphthalene, sulphone, cresol, bisphenol A, naphthol and/or biphenyl ether. Vegetable tanning agents comprise tannins which are typically polyphenols. Vegetable tanning agents can be obtained from plant leaves, roots and especially tree barks. Examples of vegetable tanning agents include the extracts of the tree barks from chestnut, oak, redoul, tanoak, hemlock, quebracho, mangrove, wattle acacia; and myrobalan. Suitable mineral tanning agents comprise chromium compounds, especially chromium salts and complexes, typically in a chromium (III) oxidation state, such as chromium (III) sulphate. Other tanning agents include aldehydes (glyoxal, glutaraldehyde and formaldehyde), phosphonium salts, metal compounds other than chromium (e.g. iron, titanium, zirconium and aluminium compounds). Preferably, the tanning agents are substantially free from chromium-containing compounds.

One or more substrates can be simultaneously treated by the method of the invention. The exact number of substrates will depend on the size of the substrates and the capacity of the apparatus utilized.

The total weight of dry substrates treated at the same time (i.e. in a single batch or washload) may be up to 50,000 kg. For textile substrates, the total weight is typically from 1 to 500 kg, more typically 1 to 300 kg, more typically 1 to 200 kg, more typically from 1 to 100 kg, even more typically from 2 to 50 kg and especially from 2 to 30 kg. For animal substrates, the total weight is normally at least about 50 kg, and can be up to about 50,000 kg, typically from about 500 to about 30,000 kg, from about 1000 kg to about 25,000 kg, from about 2000 to about 20,000 kg, or from about 2500 to about 10,000 kg.

Preferably the liquid medium is an aqueous medium, i.e. the liquid medium is or comprises water. In order of increasing preference, the liquid medium comprises at least 50 wt %, at least 60 wt %, at least 70 wt %, at least 80 wt %, at least 90 wt %, at least 95 wt % and at least 98 wt % of water. The liquid medium may optionally comprise one or more organic liquids including for example alcohols, glycols, glycol ethers, amides and esters. Preferably, the sum total of all organic liquids present in the liquid medium is no more than 10 wt %, more preferably no more than 5 wt %, even more preferably no more than 2 wt %, especially no more than 1% and most especially the liquid medium is substantially free from organic liquids.

The liquid medium preferably has a pH of from 3 to 13. The pH or the treatment liquor can differ at different times, points or stages in the treatment method according to the invention. It can be desirable to treat (particularly to clean) a substrate under alkaline pH conditions, although while higher pH offers improved performance (particularly cleaning performance) it can be less kind to some substrates. Thus, it can be desirable that the liquid medium has a pH of from 7 to 13, more preferably from 7 to 12, even more preferably from 8 to 12 and especially from 9 to 12. In a further preferred embodiment, the pH is from 4 to 12, preferably 5 to 10, especially 6 to 9, and most especially 7 to 9, particularly in order to improve fabric care. It may also be desirable that the treating of a substrate, or one or more specific stage(s) of a treatment process, is conducted under acid pH conditions. For instance, certain steps in the treatment of animal skin substrates are advantageously conducted at a pH which is typically less than 6.5, even more typically less than 6 and most typically less than 5.5, and typically no less than 1, more typically no less than 2 and most typically no less than 3. Certain fabric or garment finishing treatment methods, for instance stone-washing, may also utilise one or more acidic stage(s). An acid and/or base may be added in order to obtain the abovementioned pH values. Preferably, the abovementioned pH is maintained for at least a part of the duration, and in some preferred embodiments for all of the duration, of the agitation. In order to prevent the pH of the liquid medium from drifting during the treatment, a buffer may be used.

Preferably, the weight ratio of the liquid medium to the dry substrate is no more than 20:1, more preferably no more than 10:1, especially no more than 5:1, more especially no more than 4.5:1 and even more especially no more than 4:1 and most especially no more than 3:1. Preferably, the weight ratio of liquid medium to the dry substrate is at least 0.1:1, more preferably at least 0.5:1 and especially at least 1:1. In the present invention, it is possible to use surprisingly small amounts of liquid medium whilst still achieving good treatment performance (particularly cleaning performance), which has environmental benefits in terms of water usage, waste water treatment and the energy required to heat or cool the water to the desired temperature.

Preferably, the ratio of particles to dry substrate is at least 0.1, especially at least 0.5 and more especially at least 1:1 w/w. Preferably, the ratio of particles to dry substrate is no more than 30:1, more preferably no more than 20:1, especially no more than 15:1 and more especially no more than 10:1 w/w. Preferably, the ratio of the particles to dry substrate is from 0.1:1 to 30:1, more preferably from 0.5:1 to 20:1, especially from 1:1 to 15:1 w/w and more especially from 1:1 to 10:1 w/w.

The treatment method agitates the substrate in the presence of the solid particulate material. The agitation may be in the form of shaking, stirring, jetting and tumbling. Of these, tumbling is especially preferred. Preferably, the substrate and solid particulate material are introduced into the drum which is rotated so as to cause tumbling. The rotation can be such as to provide a centripetal force of from 0.05 to 1 G and especially from 0.05 to 0.7 G. The centripetal force is preferably as calculated at the interior walls of the drum furthest away from the axis of rotation.

The solid particulate material is able to contact the substrate, suitably mixing with the substrate during the agitation.

The agitation may be continuous or intermittent. Preferably, the method is performed for a period of from 1 minute to 10 hours, more preferably from 5 minutes to 3 hours and even more preferably from 10 minutes to 2 hours.

The treatment method is preferably performed at a temperature of from greater than 0° C. to about 95° C., preferably from 5 to 95° C., preferably at least 10° C., preferably at least 15° C., preferably no more than 90° C., preferably no more than 70° C., and advantageously no more 50° C., no more than 40° C. or no more than 30° C. Such milder temperatures allow the particles to provide the afore-mentioned benefits over larger numbers of treatment cycles. Preferably, when several batches or washloads are treated or cleaned, every treating or cleaning cycle is performed at no more than a temperature of 95° C., more preferably at no more than 90° C., even more preferably at no more than 80° C., especially at no more than 70° C., more especially at no more than 60° C. and most especially at no more than 50° C., and from greater than 0° C., preferably at least 5° C., preferably at least 10° C., preferably at least 15° C., preferably from greater than 0 to 50° C., greater than 0 to 40° C., or greater than 0 to 30° C., and advantageously from 15 to 50° C., 15 to 40° C. or 15 to 30° C. These lower temperatures again allow the particles to provide the benefits for a larger number of treatment or wash cycles.

It will be appreciated that the duration and temperature conditions described hereinabove are associated with the treating of an individual batch comprising at least one of said substrate(s).

Agitation of the substrates with the solid particulate material suitably takes place in said one or more discrete treating step(s) of the aforementioned treatment cycle. Thus, the duration and temperature conditions described hereinabove are preferably associated with the step of agitating said substrate(s) with solid particulate material, i.e. said one or more discrete treating step(s) of the aforementioned treatment cycle.

Preferably, the method is a method for cleaning a substrate, preferably a laundry cleaning method, preferably a method for cleaning a substrate which is or comprises a textile. Thus, preferably, a batch is a washload. Preferably the washload comprises at least one soiled substrate, preferably wherein the soiled substrate is or comprises a soiled textile. The soil may be in the form of, for example, dust, dirt, foodstuffs, beverages, animal products such as sweat, blood, urine, faeces, plant materials such as grass, and inks and paints. The cleaning procedure of an individual washload typically comprises the steps of agitating the washload with said solid particulate material in a cleaning apparatus for a cleaning cycle. A cleaning cycle typically comprises one or more discrete cleaning step(s) and optionally one or more post-cleaning treatment step(s), optionally one or more rinsing step(s), optionally one or more step(s) of separating the cleaning particles from the cleaned washload, optionally one or more extraction step(s) of removing liquid medium from the cleaned washload, optionally one or more drying step(s), and optionally the step of removing the cleaned washload from the cleaning apparatus.

Where the method is a cleaning method, the substrate is preferably agitated with said solid particulate material, a liquid medium, and preferably also a detergent composition. The detergent composition may comprise any one or more of the following components: surfactants, dye transfer inhibitors, builders, enzymes, metal chelating agents, biocides, solvents, stabilizers, acids, bases and buffers. In particular, the detergent composition may comprise one or more enzyme(s).

Where the method is a cleaning method, optional post-cleaning additives which may be present in a rinsing liquid medium include optical brightening agents, fragrances and fabric softeners.

In a further aspect of the invention, there is provided a kit for converting an apparatus which is not suitable for use in the treatment of substrates using a solid particulate material into an apparatus according to the present invention and defined hereinabove which is suitable for use in the treatment of substrates using a solid particulate material, wherein the apparatus comprises a housing having mounted therein a rotatably mounted drum having an inner surface and an end wall and which further comprises access means for introducing said substrates into said drum, and wherein said kit comprises solid particulate material, storage means for storage of said solid particulate material, a dispensing flow path to facilitate flow of said solid particulate material from said storage means to the interior of said drum, and a collecting flow path to facilitate flow of said particulate material from the interior of said drum to said storage means, wherein said dispensing flow path and said collecting flow path are different flow paths, and wherein said kit is adapted to allow disposing said storage means and said dispensing and collecting flow paths on one or more interior surface(s) of the drum.

Preferably, said kit comprises storage means for storage of said solid particulate material, one or more elongate protrusions, and solid particulate material, wherein said kit is adapted to allow affixing of said storage means and said elongate protrusion(s) to one or more interior surface(s) of the drum so that said drum comprises a dispensing flow path to facilitate flow of said solid particulate material from said storage means to the interior of said drum, and a collecting flow path to facilitate flow of said particulate material from the interior of said drum to said storage means, wherein said dispensing flow path and said collecting flow path are different flow paths, wherein said collecting flow path comprises a collecting aperture which is located in an elongate protrusion at its proximal end, and wherein said dispensing flow path comprises a dispensing aperture which is located in an elongate protrusion at its distal end or closer to its distal end than its proximal end.

Preferably, said kit further comprises a frusto-conical surface, preferably in the form of a plurality of sections or inserts, adapted to allow affixing of said frusto-conical surface to the inner surface of the drum such that the frusto-conical surface is inclined in a downwards direction from the front of the drum to the end wall of the drum, preferably wherein the frusto-conical surface is configured to define at least one collecting channel in the inner surface at the juncture of the inner surface and the end-wall of the drum, wherein the collecting channel extends along the juncture of the inner surface and the end-wall of the drum to said collecting aperture, and is thus configured to bias solid particulate material towards the collecting aperture during rotation of the drum in a collecting direction.

According to a further aspect of the present invention, there is provided a method of constructing an apparatus according to the present invention and as defined hereinabove which is suitable for use in the treatment of substrates using a solid particulate material, the method comprising retrofitting a starting apparatus which is not suitable for use in the treatment of substrates using a solid particulate material and which comprises a housing having mounted therein a rotatably mounted drum having an inner surface and an end wall and which further comprises access means for introducing said substrates into said drum, wherein said retrofitting comprises the steps of:

(i) providing solid particulate material, providing one or more storage means for storage of solid particulate material, providing a dispensing flow path to facilitate flow of said solid particulate material from said storage means to the interior of said drum, and providing a collecting flow path to facilitate flow of said particulate material from the interior of said drum to said storage means, wherein said dispensing flow path and said collecting flow path are different flow paths; and (ii) disposing said storage means and said dispensing and collecting flow paths on one or more interior surface(s) of the drum.

Preferably, the retrofitting comprises the steps of:

(i) providing one or more storage means, one or more elongate protrusions, and solid particulate material; and (ii) affixing said storage means and said elongate protrusion(s) to one or more interior surface(s) of the drum so that said drum comprises a dispensing flow path to facilitate flow of said solid particulate material from said storage means to the interior of said drum, and a collecting flow path to facilitate flow of said particulate material from the interior of said drum to said storage means, wherein said dispensing flow path and said collecting flow path are different flow paths, wherein said collecting flow path comprises a collecting aperture which is located in an elongate protrusion at its proximal end, and wherein said dispensing flow path comprises a dispensing aperture which is located in an elongate protrusion at its distal end or closer to its distal end than its proximal end.

Preferably, the retrofitting further comprises the steps of providing a frusto-conical surface, preferably in the form of a plurality of sections or inserts, and affixing said frusto-conical surface to the inner surface of the drum such that the frusto-conical surface is inclined in a downwards direction from the front of the drum to the end wall of the drum. Preferably, the frusto-conical surface is configured to define at least one collecting channel in the inner surface at the juncture of the inner surface and the end-wall of the drum, wherein the collecting channel extends along the juncture of the inner surface and the end-wall of the drum to said collecting aperture, and is thus configured to bias solid particulate material towards the collecting aperture during rotation of the drum in a collecting direction.

The invention is further illustrated with reference to the following figures.

Figure 1:
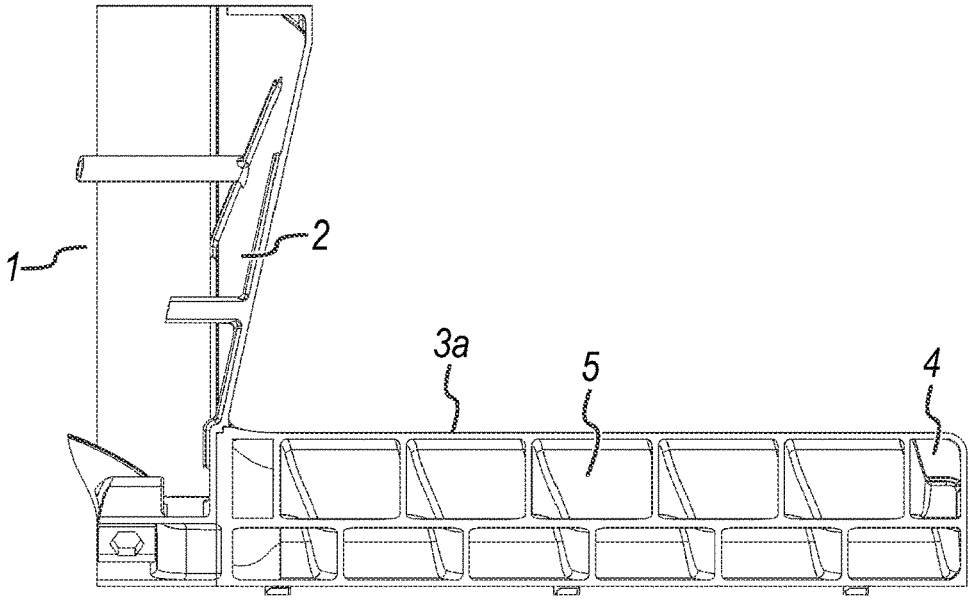
FIG. 1 illustrates a section of the apparatus showing the end wall (1) of the drum having disposed therein storage means (2). A first elongate protrusion (3*a*) comprises a dispensing aperture (4) at its distal end and a dispensing flow path (5) which is configured as an Archimedean screw.
Figure 2:
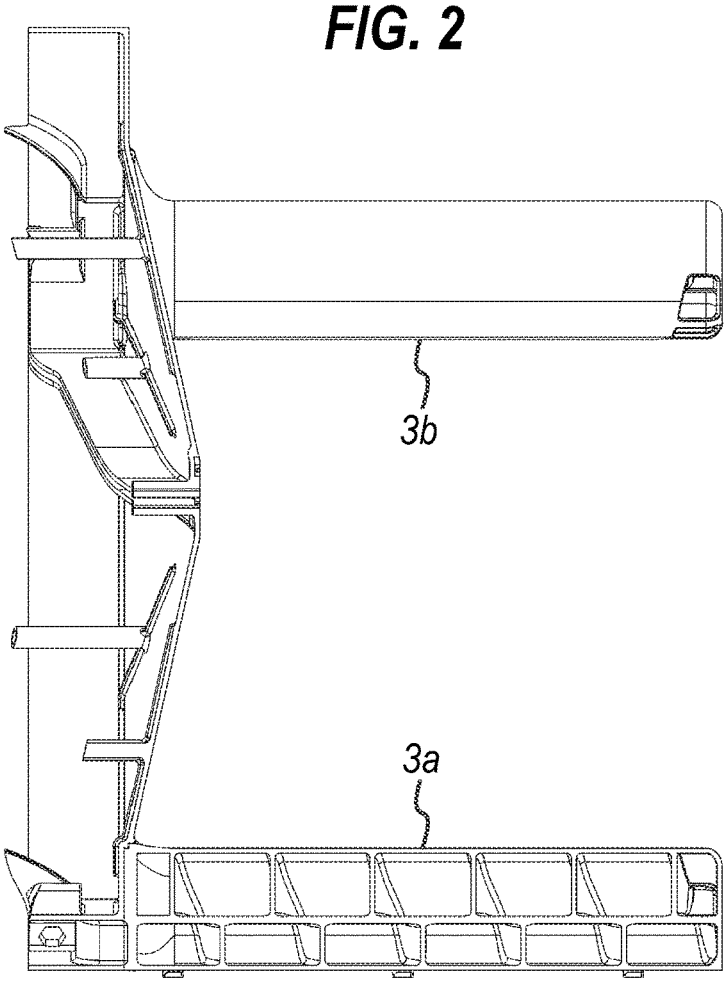
FIG. 2 illustrates a larger section of the drum showing the first elongate protrusion and a second elongate protrusion 3*b*.
Figure 3:
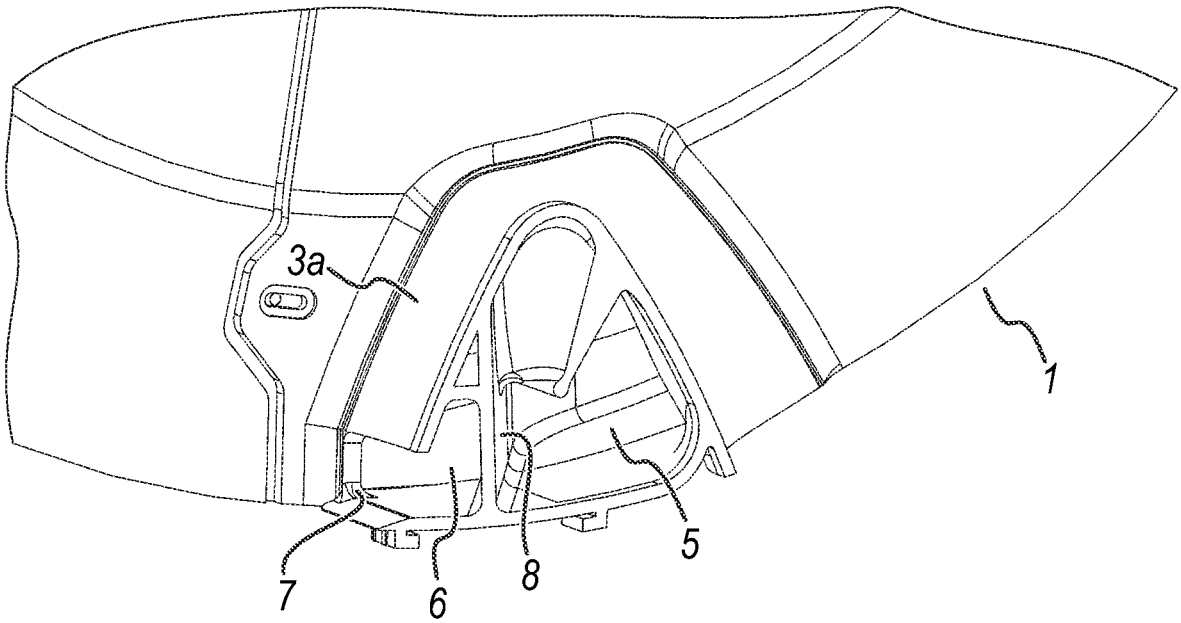

FIG. 3 shows the region of the apparatus where elongate protrusion (3*a*) meets the end wall (1) of the drum in which is disposed the storage means. Solid particulate material enters the storage means via the collecting flow path (6) and collecting aperture (7). A portion of deflector wall (8) separates the collecting flow path (6) from the dispensing flow path (5).

Figure 4:
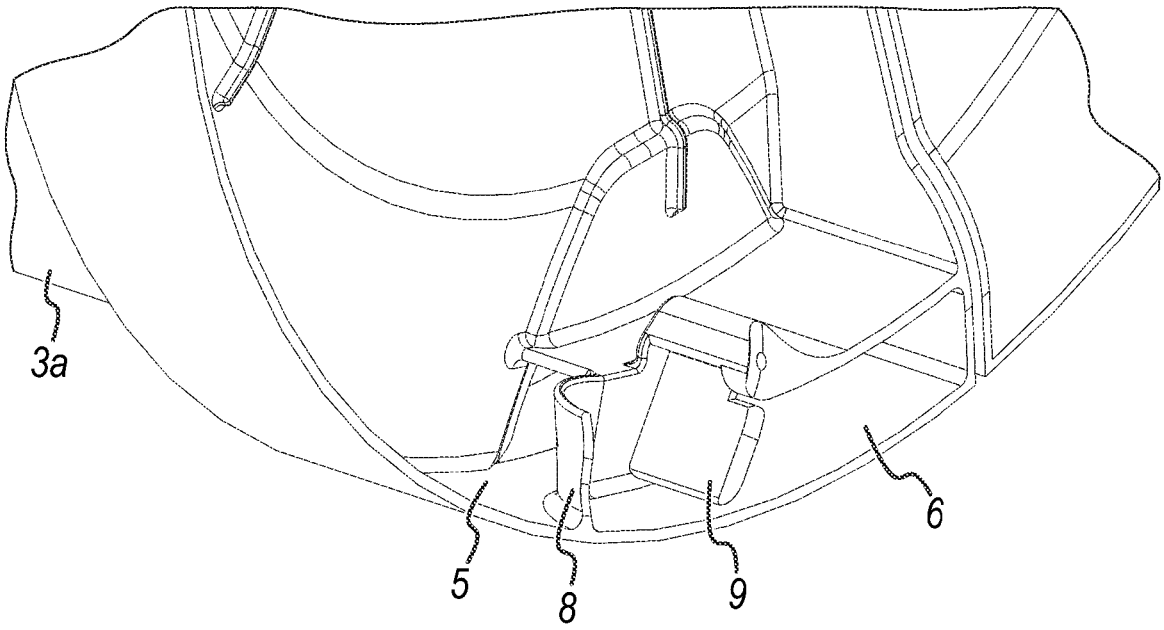

FIG. 4 shows in more detail the arrangement of the dispensing flow path (5), collecting flow path (6) and deflector wall (8) from the opposite side, relative to FIG. 3. A portion of elongate protrusion (3*a*) is also shown. One-way flap-valve (9) prevents egress of solid particulate material from the storage means into the interior of the drum via the collecting pathway.

Figure 5:
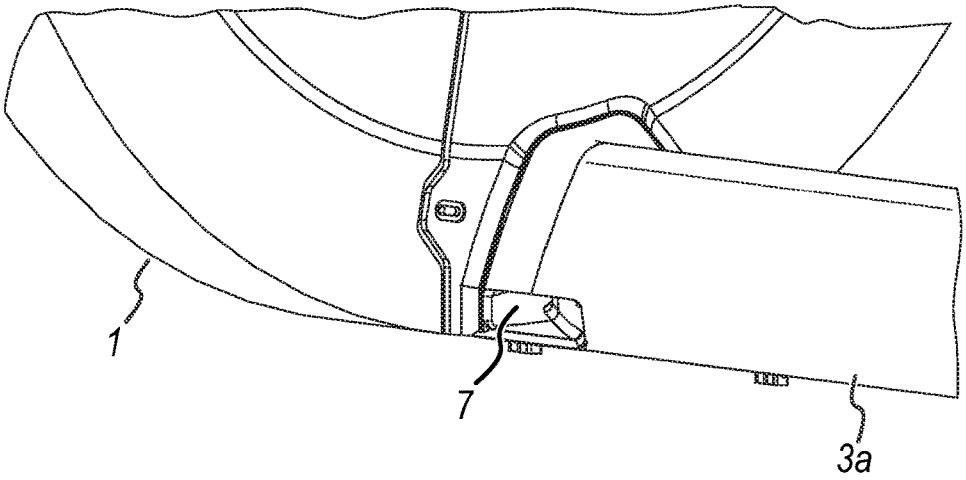

FIG. 5 shows collecting aperture (7) in the proximal end of elongate protrusion (3*a*) at the end wall (1) of the drum.

Figure 6:
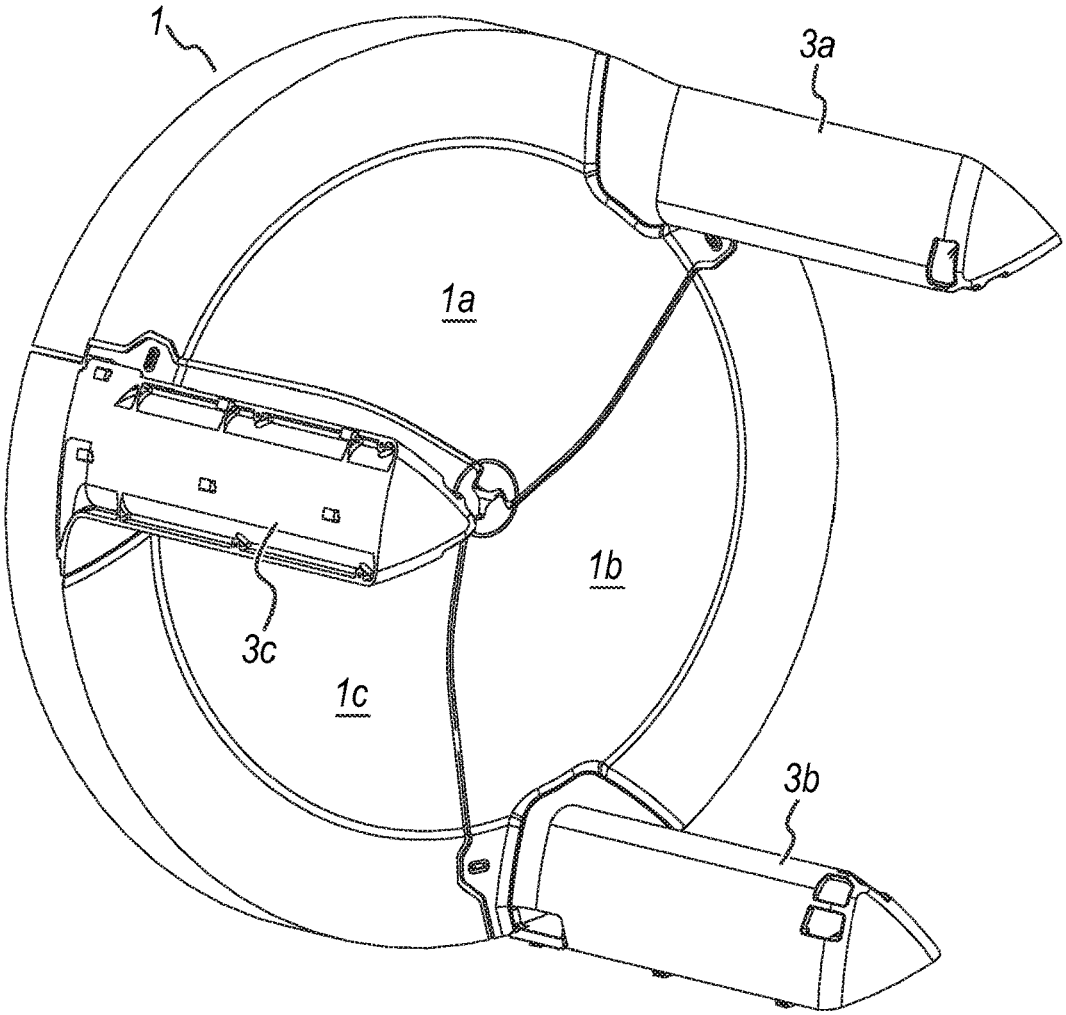

FIG. 6 shows a larger perspective view of the end wall (1) of a drum comprising storage means in three sections (1*a*, 1*b*, and 1*c*) allowing it to be retrofitted to existing drums. The figure also shows elongate protrusions (3*a*, 3*b* and 3*c*).

Figure 7:
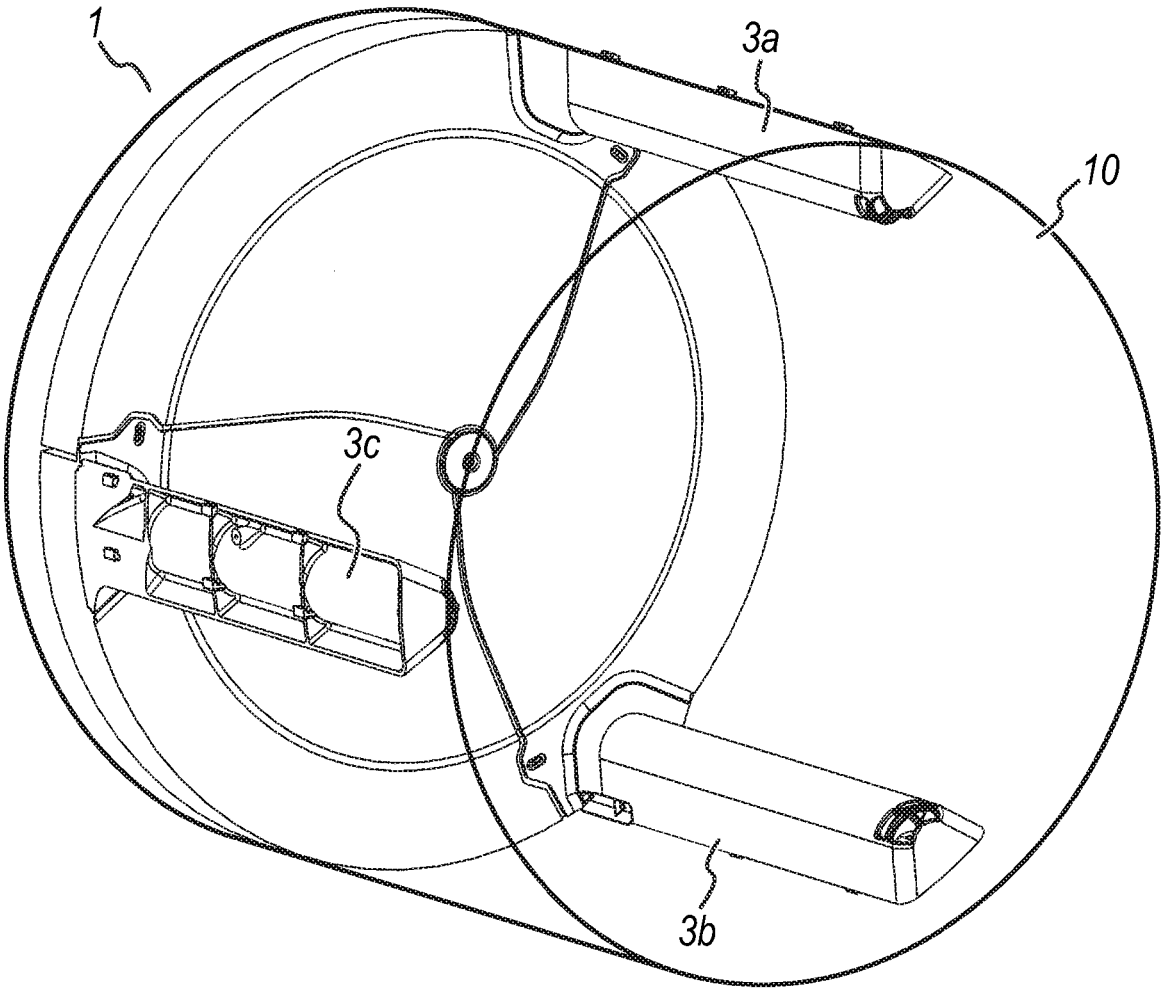

FIG. 7 shows the end wall (1) of a drum comprising storage means therein, and elongate protrusions (3*a*, 3*b* and 3*c*) disposed on the cylindrical inner surface (10) of the drum.

Figure 8:
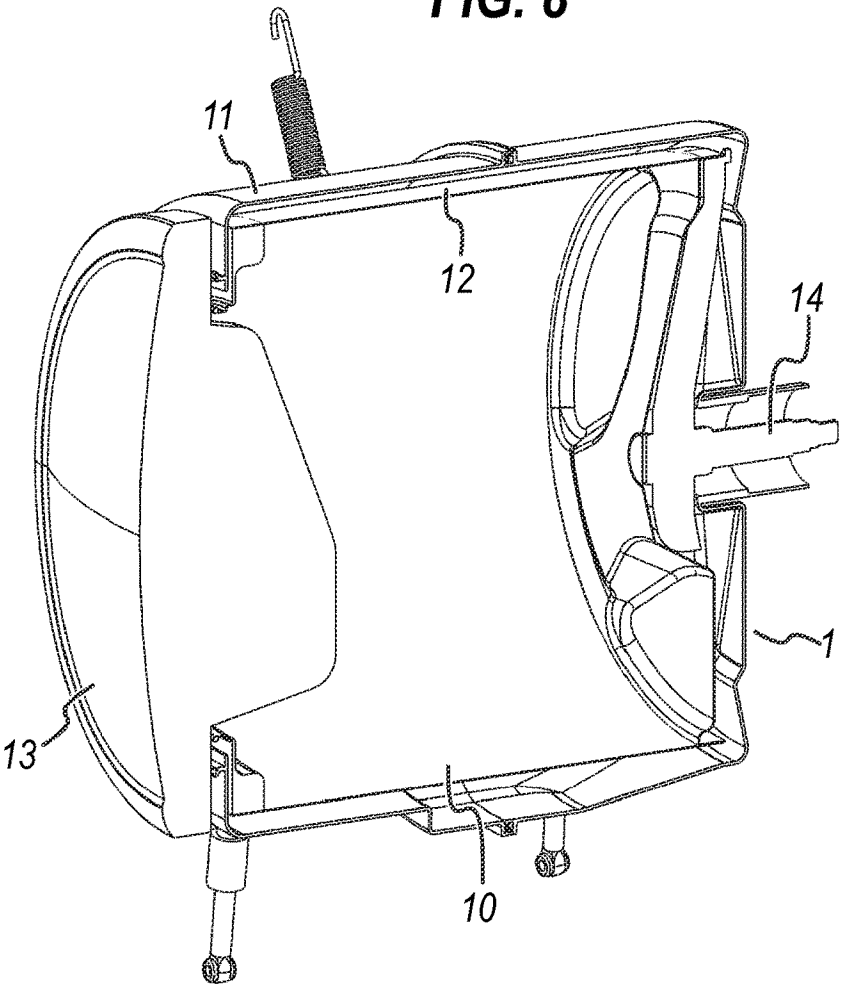

FIG. 8 shows certain elements of a rotatable drum (12) having an end wall (1) and a cylindrical inner surface (10), and located in a housing (11), wherein the interior of the drum is accessed by access means (13) and wherein the drum is connected to drive shaft (14) from a drive means (not shown) to effect rotation of the drum.

Figure 9:
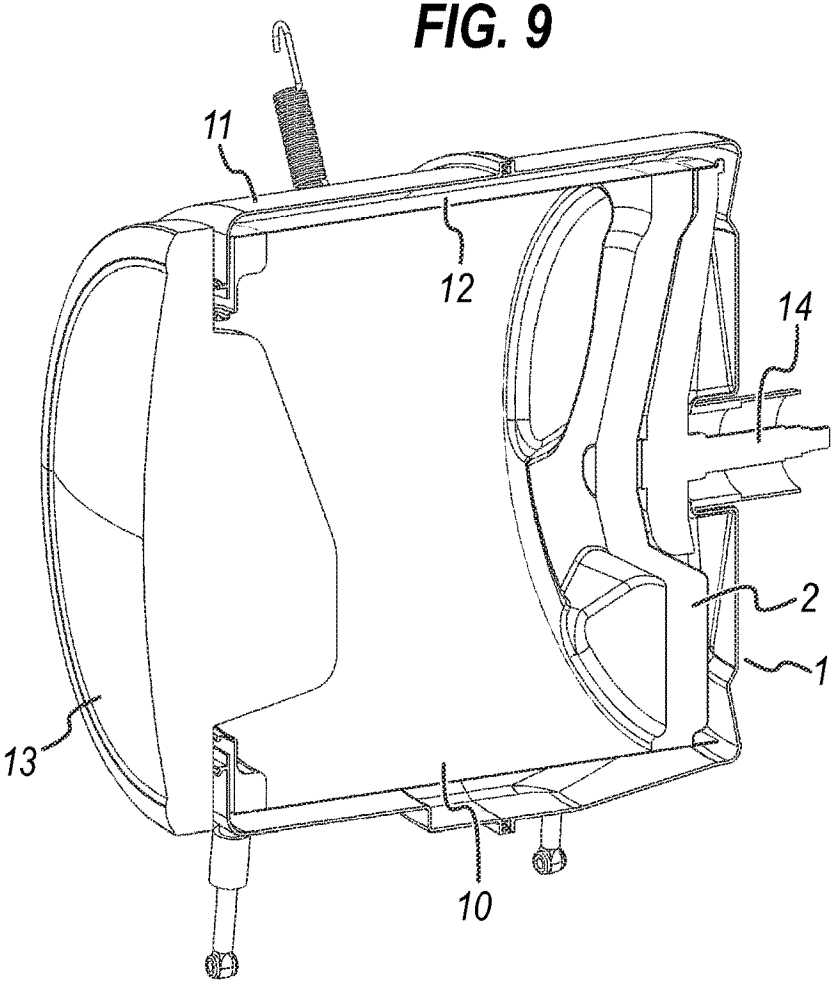

FIG. 9 shows the arrangement of FIG. 8 wherein a storage means (2) is disposed in, or retrofitted onto, the existing end wall (1) of the drum.

Figure 11:
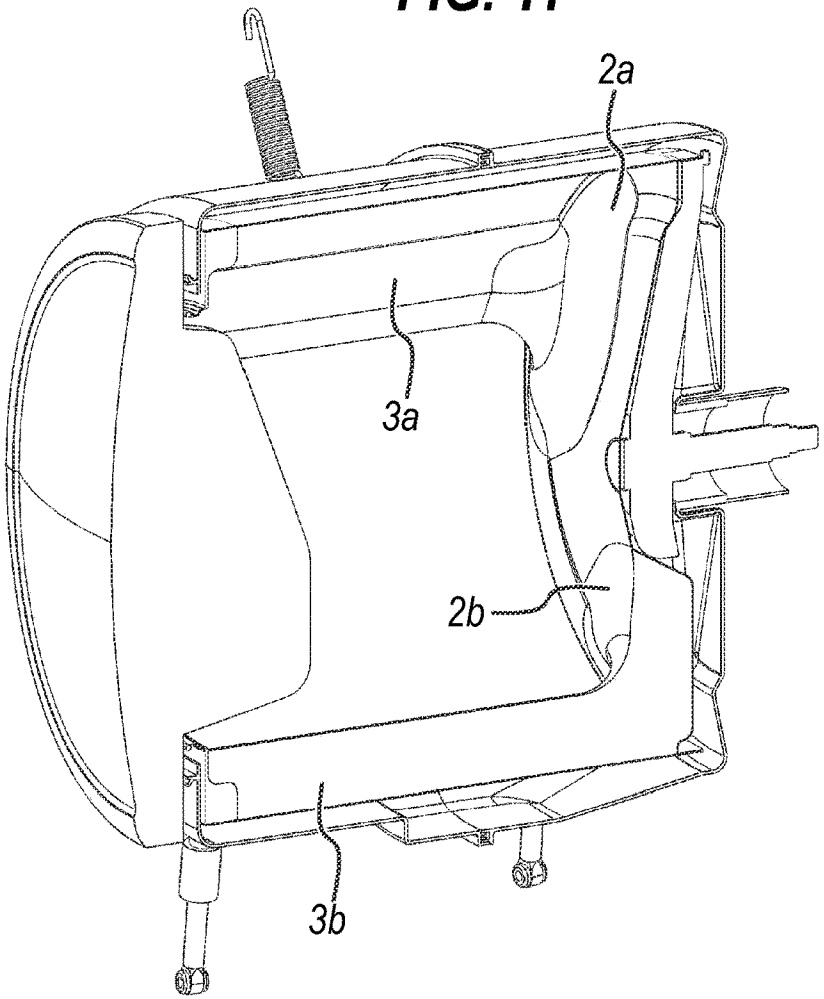
Figure 10:
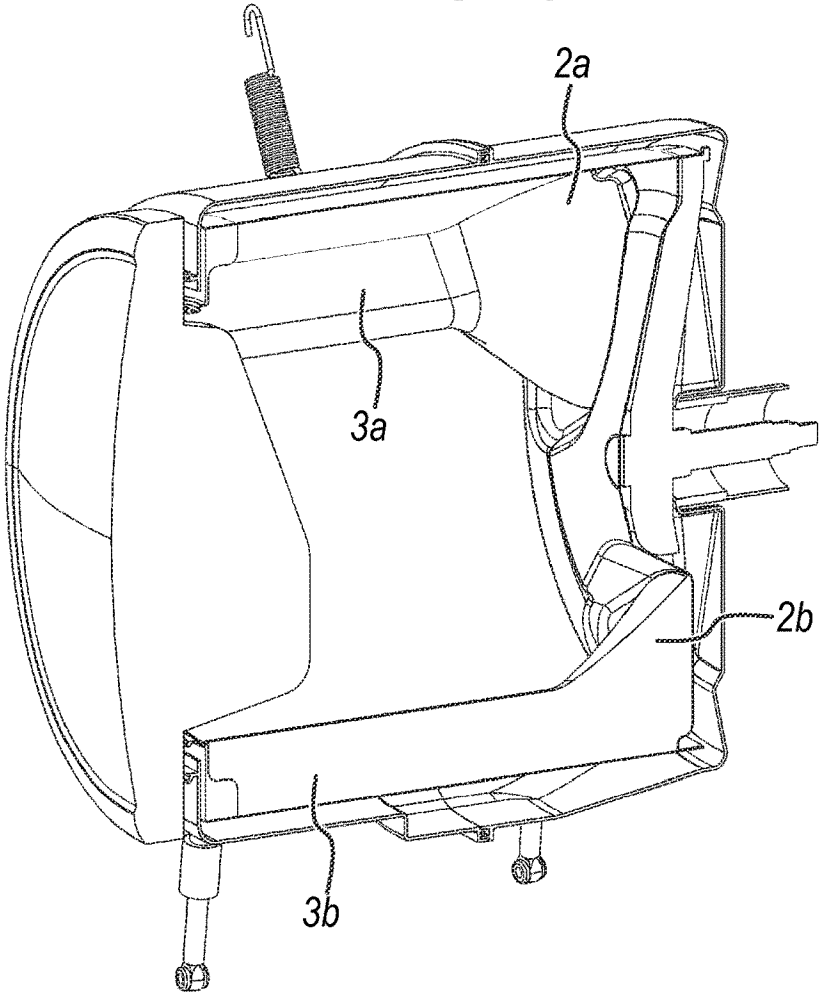

FIGS. 10 and 11 show an arrangement with a plurality of storage means (2*a*, 2*b*) and a plurality of elongate protrusions (3*a*, 3*b*).

Figure 12:
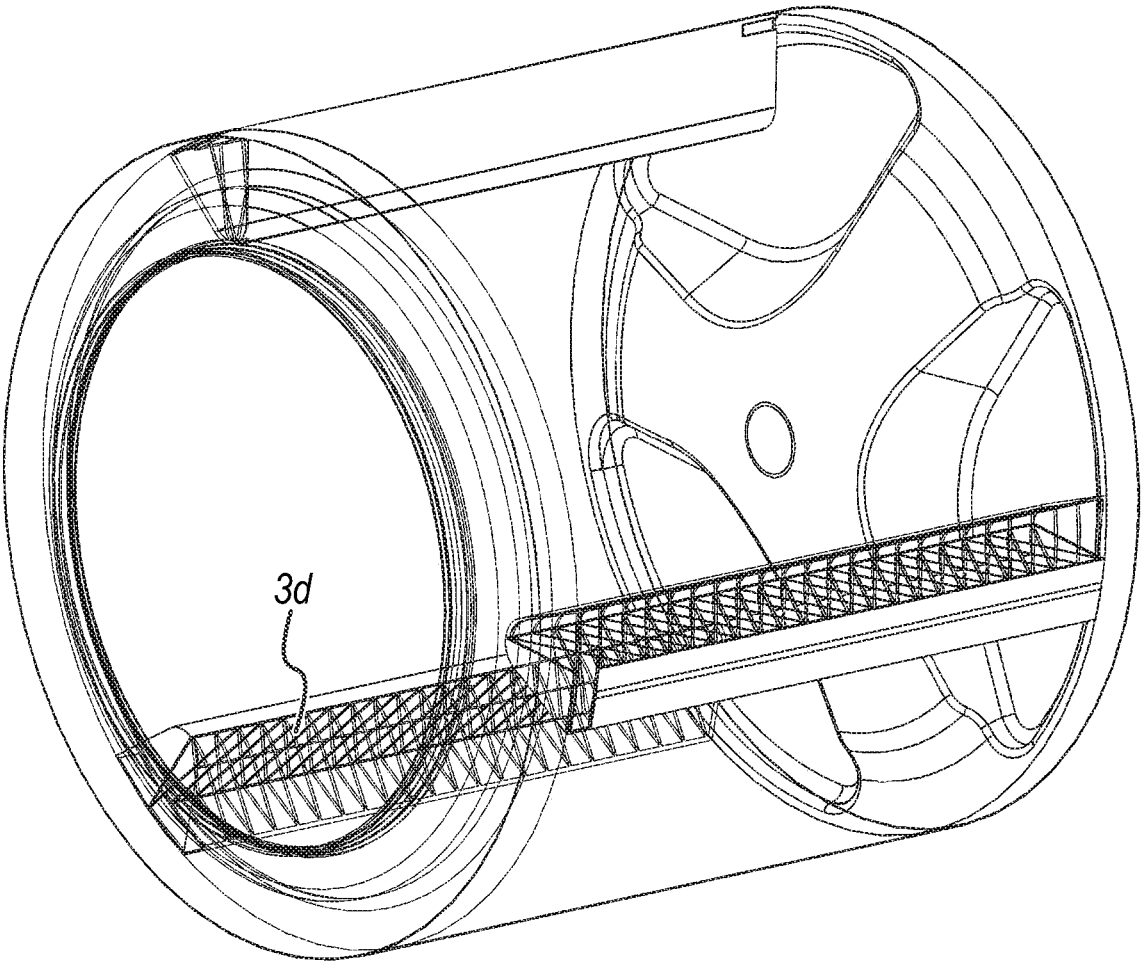
Figure 13:
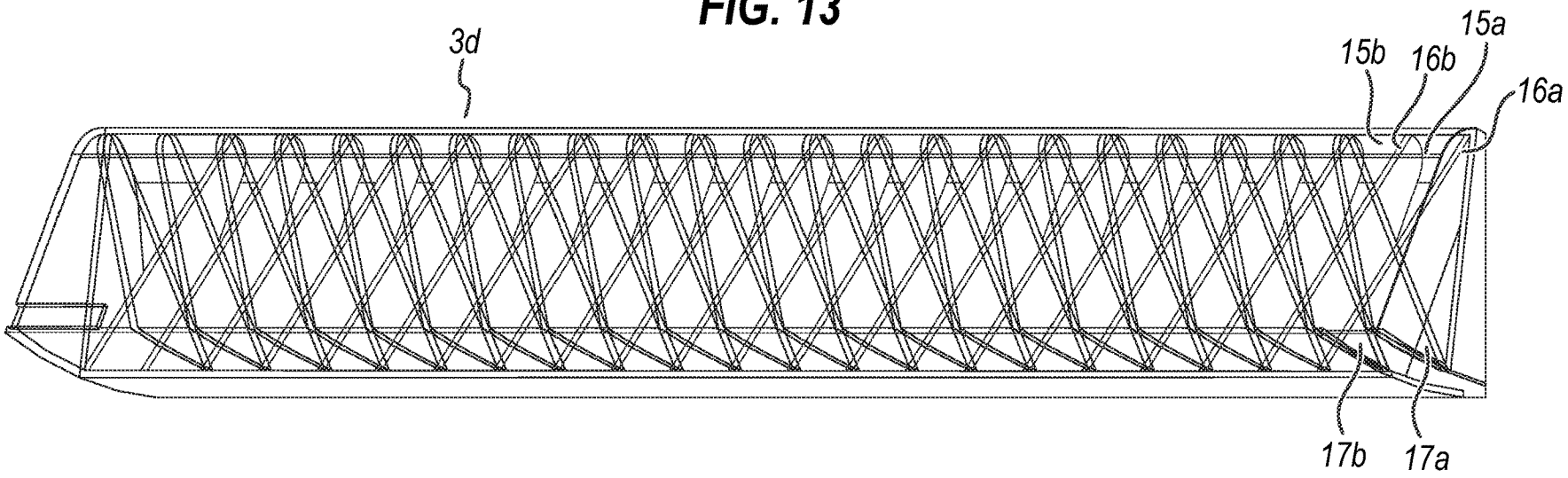
Figure 14:
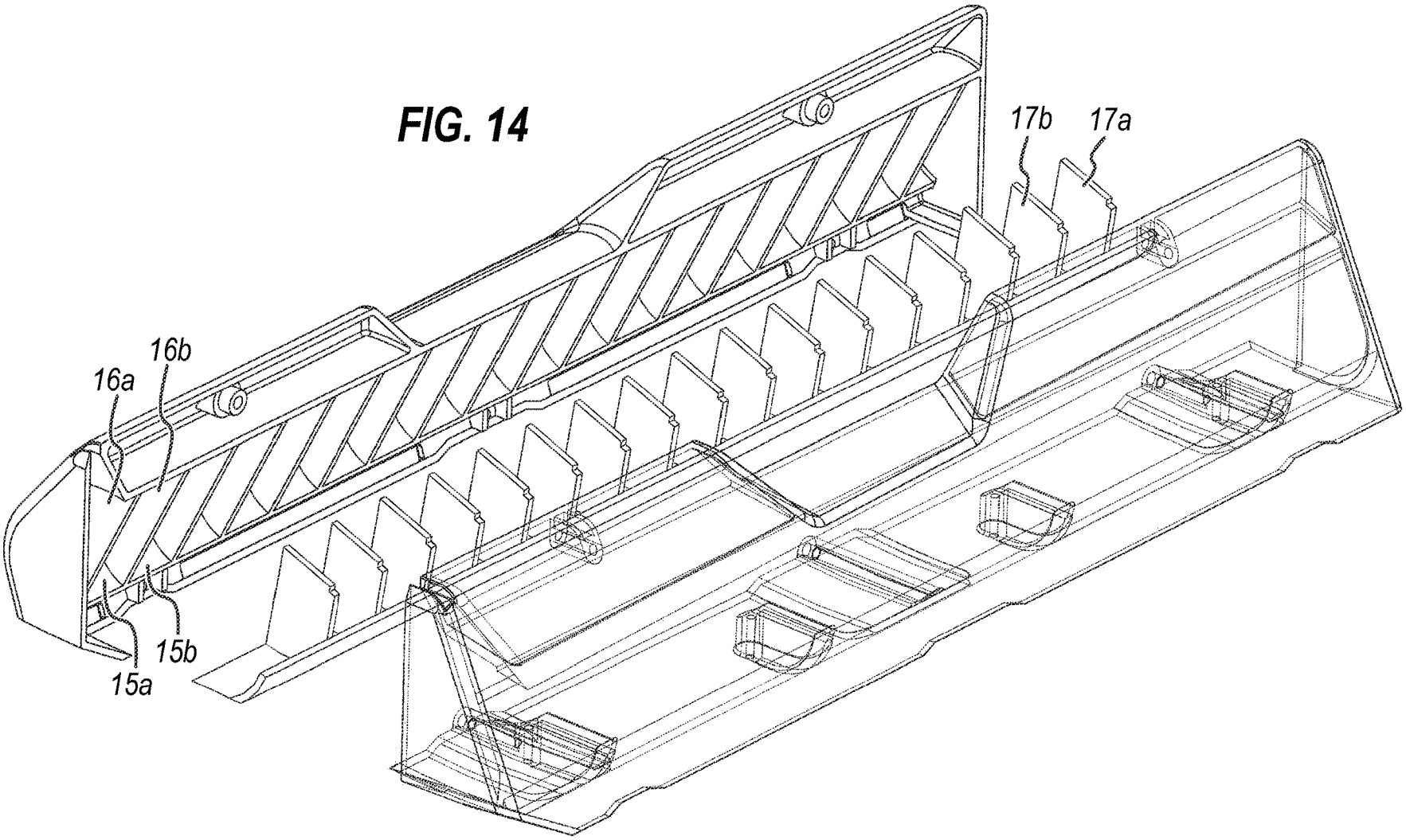

FIGS. 12, 13 and 14 show an elongate protrusion (3*d*), having the paternoster configuration described herein, wherein the dispensing flow path comprises a chain of open compartments (15*a, b*) formed by a first series of inclined, substantially parallel vanes (16*a, b*) and a second series of inclined, substantially parallel vanes (17*a, b*). FIG. 14 shows the elongate protrusion and dispensing flow path in dissembled form.

Figure 15:
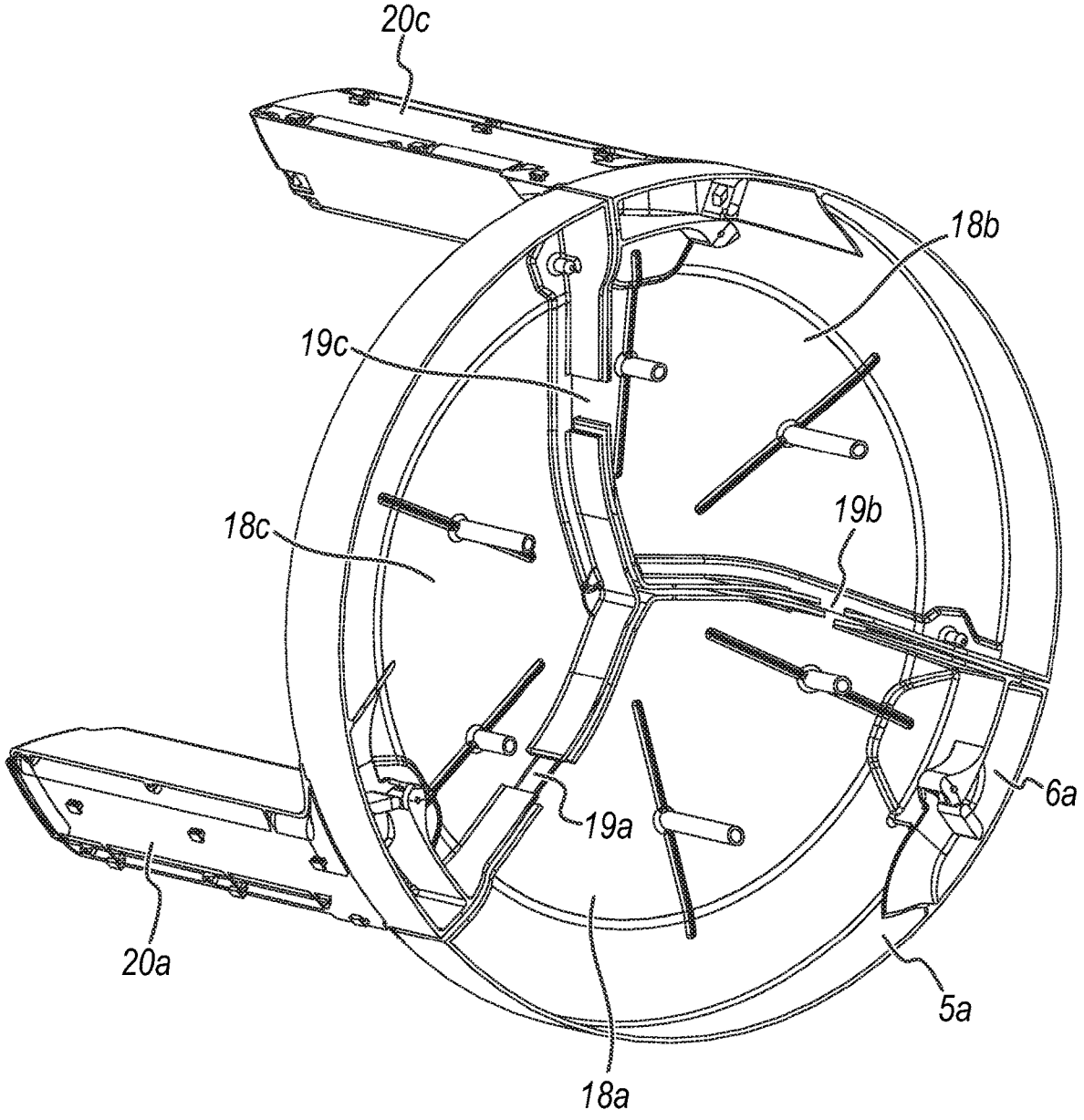

FIG. 15 shows a multi-compartment storage means located in the end-wall of the drum as hereinbefore described, comprising compartments 18*a*, 18*b* and 18*c*. Each compartment is in fluid communication with an adjacent compartment via communicating apertures 19*a*, 19*b* and 19*c*. Each compartment is associated with a single lifter 20*a* and 20*c* (lifter 20*b* not shown), and each compartment is associated with a single dispensing flow path (5*a*) and a single collecting flow path (6*a*) (shown only for compartment 18*a*.

Figure 16:
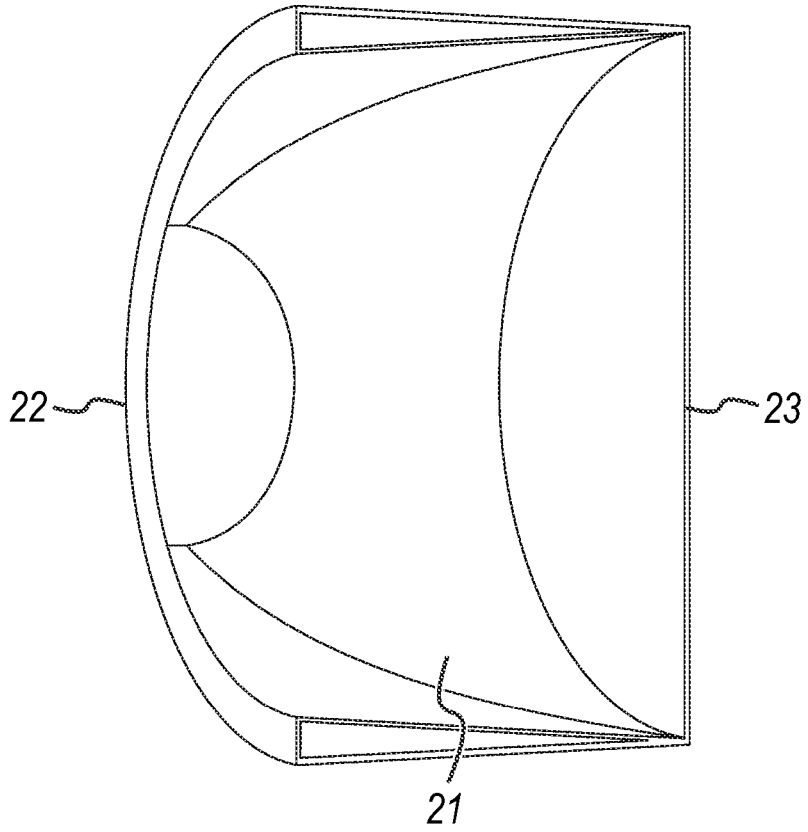

FIG. 16 shows a cross-section of a drum having a generally frusto-conical surface (21), inclined downwardly from the front of the drum (22) to the end wall of the drum (23).

Figure 17:
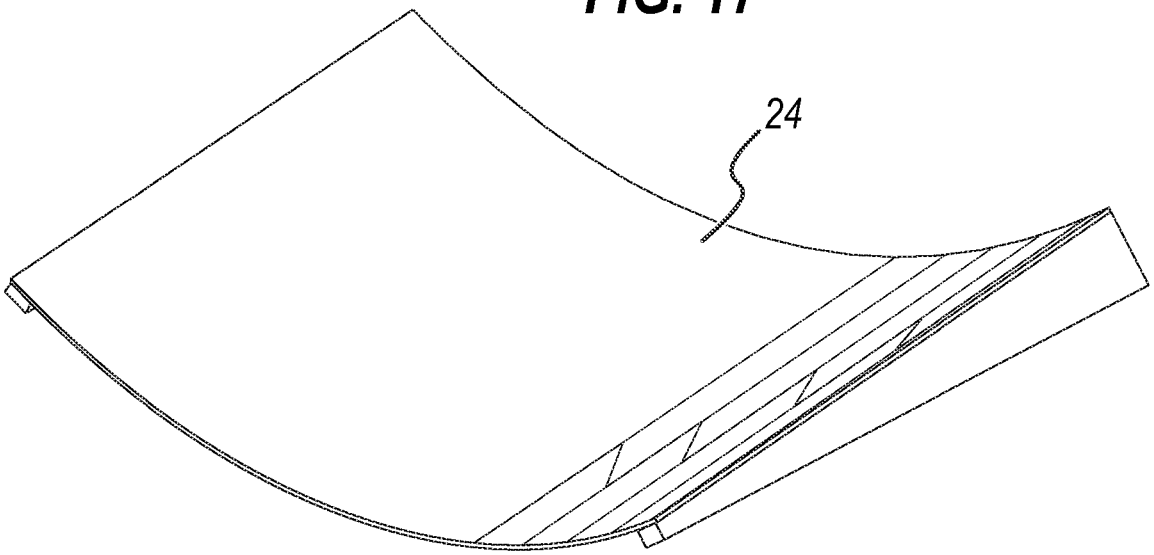

FIG. 17 shows a section (24) of a frusto-conical surface suitable for retro-fitting to a conventional apparatus for converting a drum having a cylindrical inner surface to a drum having a frusto-conical inner surface. Such a frusto-conical surface section is suitable as an insert for disposing between elongate protrusions (or "lifters"; not shown) disposed on the inner surface of the drum (not shown).

Figure 18:
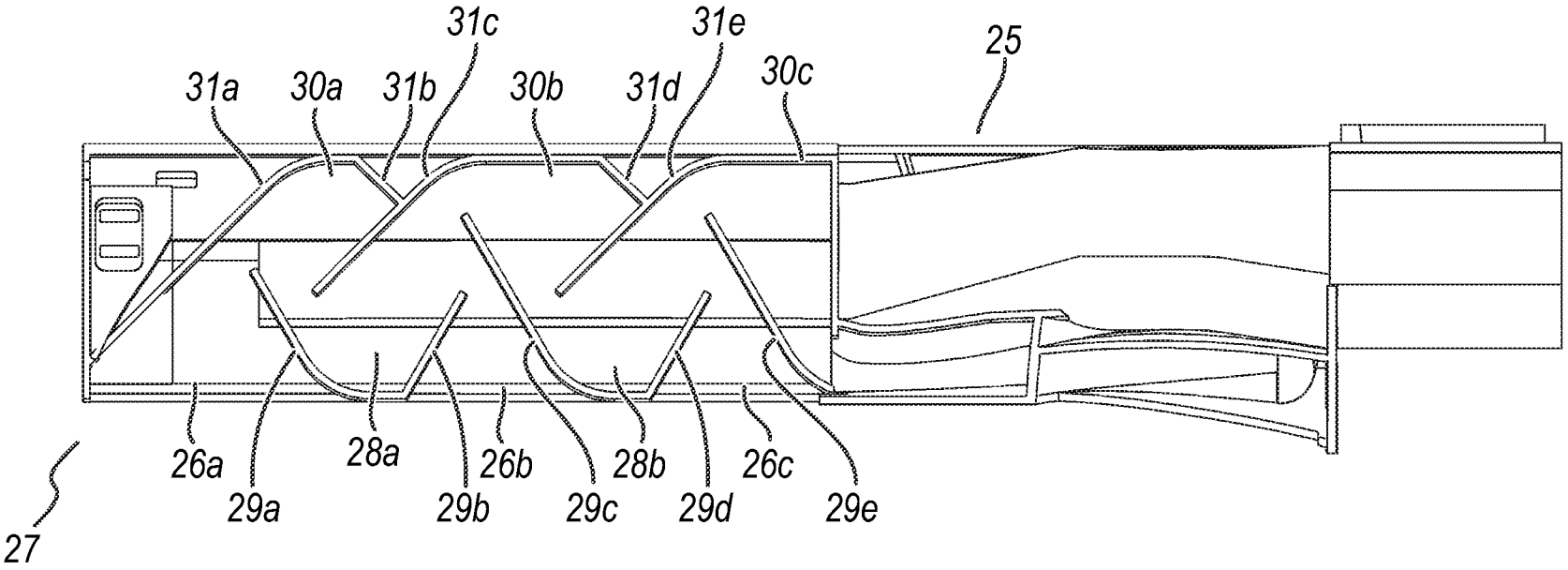

FIG. 18 illustrates the underside of an elongate protrusion (25) of the herringbone embodiment. A plurality of collecting apertures (26*a*, 26*b*, 26*c*) is disposed on the first side (27) of the elongate protrusion (i.e. the leading side of the elongate protrusion during rotation of the drum in a collecting direction). A first series of vanes (29*a*, 29*b*, 29*c*, 29*d*, 29*e*) is arranged to form a first series of U-shapes (28*a*, 28*b*), and a second series of vanes (31*a*, 31*b*, 31*c*, 31*d*, 31*e*) is arranged to form a second series of U-shapes (30*a*, 30*b*, 30*c*), wherein said first and second series of vanes and U-shapes are disposed in an opposing, interlocking but non-contacting and staggered arrangement, to form a chain of open compartments which provides a tortuous pathway from the collecting apertures to the collecting flow path and storage means (not shown).

The invention claimed is:

1. An apparatus for use in the treatment of substrates with a solid particulate material, said apparatus comprising:

(a) a housing having mounted therein a rotatably mounted drum having an inner surface and an end wall; and (b) access means for introducing said substrates into said drum, wherein said drum comprises storage means for storage of said solid particulate material, wherein the storage means is comprised within the drum by being attached to or integral with said drum such that the storage means rotates with rotation of said drum, wherein said drum further comprises a plurality of flow paths to facilitate flow of said solid particulate material between said storage means and an interior of said drum, wherein the plurality of flow paths located in said drum comprises a dispensing flow path extending all the way from the storage means to the interior of the drum to facilitate flow of said solid particulate material from said storage means to the interior of said drum and a collecting flow path extending all the way from the interior of the drum to the storage means to facilitate flow of said particulate material from the interior of said drum to said storage means, wherein said dispensing flow path and said collecting flow path are different flow paths and wherein said dispensing flow path and said collecting flow path rotate with rotation of said drum; and wherein said drum has at least one elongate protrusion located on said inner surface of said drum wherein the at least one elongate protrusion extends in a direction away from said end wall; and wherein the collecting flow path comprises a collecting aperture which is located in the at least one elongate protrusion.

2. The apparatus of claim 1, wherein said flow of said solid particulate material from the storage means towards the interior of the drum is facilitated by the rotation of said drum in a dispensing direction and/or the flow of said solid particulate material from the interior of the drum towards the storage means is facilitated by the rotation of said drum in a collecting direction, wherein rotation in the dispensing direction is in the opposite rotational direction to rotation in the collecting direction.

3. The apparatus of claim 1, wherein the drum is configured to bias solid particulate material present inside the drum towards said collecting aperture during rotation of the drum in a collecting direction, and/or the dispensing flow path comprises a dispensing aperture and the drum is configured to bias solid particulate material present inside the storage means and/or the dispensing flow path towards a dispensing aperture during rotation of the drum in a dispensing direction.

4. The apparatus of claim 1, wherein said drum comprises from two to six elongate protrusions.

5. The apparatus of claim 1, wherein the at least one elongate protrusion extends from said end wall and a proximal end proximal to the end wall and a distal end distal to the end wall.

6. The apparatus of claim 5, wherein the collecting aperture is located in the at least one elongate protrusion at the proximal end; and/or the dispensing flow path comprises a dispensing aperture which is located in the at least one elongate protrusion at the distal end or closer to the distal end than the proximal end, or from at least half way along the at least one elongate protrusion from the proximal end to the distal end thereof, or wherein the at least one elongate protrusion has a plurality of dispensing apertures spaced along the length of the at least one elongate protrusion from the proximal end to the distal end.

7. The apparatus of claim 5, wherein said dispensing flow path is located at least in part in the at least one elongate protrusion.

8. The apparatus of claim 5, wherein said drum and/or said at least one elongate protrusion are configured to bias solid particulate material present inside the drum towards the collecting flow path.

9. The apparatus of claim 5, wherein the axis of said drum is horizontal, or wherein said apparatus is configured such that for at least a part of said treatment the drum is tilted such that an axis of the drum defines an angle A to the horizontal plane which is greater than 0° and less than 10° and such that the drum is inclined in a downwards direction from the front of the drum to the end wall of the drum.

10. The apparatus of claim 5, wherein the at least one elongate protrusion comprises the collecting aperture and optionally a second collecting aperture, disposed in a first side thereof at one or more position(s) from the proximal end to the distal end thereof, wherein the first side of the at least one elongate protrusion is a leading side of the at least one elongate protrusion during rotation of the drum in a collecting direction, and wherein the collecting aperture and optional second aperture is/are in fluid communication with the collecting flow path via a chain of open compartments which are located in a base or on an underside of the at least one elongate protrusion and which are configured to bias solid particulate material towards the collecting flow path and the storage means during rotation of the drum.

11. The apparatus of claim 5, wherein said dispensing flow path comprises a chain of open compartments located in the at least one elongate protrusion, wherein said open compartments are formed by a first series of inclined vanes parallel to each other and a second series of inclined vanes parallel to each other, wherein said first and second series are disposed along at least part of the length of the interior of the at least one elongate protrusion, wherein said first series of vanes are disposed in a facing arrangement to said second series of vanes, wherein said first series of vanes are not parallel to said second series of vanes, and wherein during rotation of the drum in a dispensing direction, the compartments and vanes are configured to bias solid particulate material present inside the storage means and/or the dispensing flow path towards a dispensing aperture located in said at least one elongate protrusion (i) at the distal end; or (ii) closer to the distal end than the proximal end of the at least one elongate protrusion; or (iii) at least half way along the at least one elongate protrusion from the proximal end to the distal end thereof.

12. The apparatus of claim 5, wherein said dispensing flow path comprises opposing and offset saw-tooth surfaces configured to bias solid particulate material present inside the storage means and/or the dispensing flow path during rotation of the drum in a dispensing direction towards a dispensing aperture located in said at least one elongate protrusion (i) at the distal end or (ii) closer to the distal end than the proximal end or (iii) at least half way along the at least one elongate protrusion from the proximal end to the distal end thereof.

13. The apparatus of claim 1, wherein the storage means comprises 2 to 6 compartments, wherein said compartments are arranged so as to retain balance of the drum during rotation.

14. The apparatus of claim 1, wherein the storage means is or comprises at least one cavity located in the end wall of the drum.

15. The apparatus of claim 1, wherein the storage means comprises multiple compartments located in the end wall of the drum, wherein each of the compartments is defined by a cavity bound by a first wall and a second wall which each extend outwards from the rotational axis of the drum towards an inner wall of the drum.

16. The apparatus of claim 1, wherein the storage means comprises:

at least one spiral or helical pathway located in the end wall of the drum; and/or a toroidal cavity located at a juncture of said inner surface and said end wall or wherein the storage means comprises a cavity having a shape defined by a toroidal segment located at the juncture of said inner surface and said end wall; and/or at least one cavity located in an inner wall of the drum.

17. The apparatus of claim 1, wherein:

the storage means further comprises one or more perforations which have dimensions smaller than the dimensions of the solid particulate material so as to permit passage of fluids through said perforations into and out of the storage means, but to prevent egress of said solid particulate material through said perforations;

and/or the inner surface of said drum comprises perforations which have dimensions smaller than the dimensions of the solid particulate material so as to permit passage of fluids into and out of said drum but to prevent egress of said solid particulate material.

18. The apparatus of claim 1, wherein said collecting flow path comprises a valve to prevent egress of said solid particulate material from said storage means to the interior of said drum via said collecting flow path.

19. The apparatus of claim 1, wherein a portion of a deflector wall separates the collecting flow path from the dispensing flow path.

20. The apparatus of claim 1, wherein said dispensing and said collecting flow paths have no internal dimension which is less than at least 2 times a longest dimension of the solid particulate material.

21. The apparatus of claim 1, wherein said treatment of substrates with solid particulate material is in the presence of a liquid medium and/or one or more treatment formulation(s).

22. The apparatus of claim 1, which comprises said solid particulate material, wherein particles of the solid particulate material have an average particle size of from 1 mm to 20 mm.

23. The apparatus of claim 9, wherein said dispensing flow path comprises an Archimedian screw arrangement located in the at least one elongate protrusion.

24. The apparatus of claim 23, wherein the cross-section of said Archimedian screw is circular, or tri-lobal or other multi-lobal configuration.

* * * * *